US007201676B2

(12) United States Patent
Rumfola, III

(10) Patent No.: US 7,201,676 B2
(45) Date of Patent: Apr. 10, 2007

(54) GAME APPARATUS

(75) Inventor: Ross Rumfola, III, Akron, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 11/202,369

(22) Filed: Aug. 12, 2005

(65) Prior Publication Data

US 2007/0037638 A1 Feb. 15, 2007

(51) Int. Cl.
*A63B 63/08* (2006.01)
*A63B 69/00* (2006.01)

(52) U.S. Cl. ..... 473/447; 473/433; 473/448

(58) Field of Classification Search ..... 472/422, 472/432–435, 447–449, 472, 479–489; 273/317.3; 434/247, 248
See application file for complete search history.

(56) References Cited

U.S. PATENT DOCUMENTS

| | | | | |
|---|---|---|---|---|
| 469,554 | A | | 2/1892 | Favor |
| 1,574,201 | A | | 2/1926 | Lynch |
| 2,049,593 | A | | 8/1936 | Schabinger |
| 2,125,679 | A | | 8/1938 | Longstreet |
| 2,257,934 | A | | 10/1941 | Bell |
| 2,421,220 | A | | 5/1947 | Robinson, II et al. |
| 3,362,709 | A | | 1/1968 | Rossini |
| 3,362,712 | A | | 1/1968 | Wagner |
| 3,810,618 | A | | 5/1974 | Nedwick |
| 3,901,506 | A | | 8/1975 | Caveney |
| 4,013,292 | A | | 3/1977 | Cohen et al. |
| 4,226,416 | A | * | 10/1980 | Callanan ..... 473/448 |
| 4,286,779 | A | | 9/1981 | Collins |
| 4,468,027 | A | | 8/1984 | Pangburn |
| 4,492,380 | A | | 1/1985 | Saytar |
| 4,826,166 | A | | 5/1989 | Baker et al. |
| 4,838,549 | A | | 6/1989 | Woodall |
| 4,858,920 | A | | 8/1989 | Best |
| 4,869,502 | A | * | 9/1989 | Wares ..... 473/433 |
| 4,887,812 | A | | 12/1989 | Moormann |
| 4,955,605 | A | | 9/1990 | Goldfarb |
| 4,973,054 | A | | 11/1990 | Metrosky |
| D315,383 | S | | 3/1991 | Cochran et al. |
| 5,007,637 | A | | 4/1991 | Foley |
| 5,037,095 | A | | 8/1991 | Nedwick |
| D321,737 | S | | 11/1991 | Lo |
| 5,074,552 | A | | 12/1991 | Gomez et al. |
| 5,096,191 | A | | 3/1992 | Fang |
| 5,100,133 | A | | 3/1992 | Riviezzo et al. |
| D326,128 | S | | 5/1992 | Smith |
| 5,129,648 | A | | 7/1992 | Sweeney et al. |
| 5,133,546 | A | | 7/1992 | Matherne et al. |
| 5,163,680 | A | | 11/1992 | Amron |
| 5,224,699 | A | | 7/1993 | Zaruba |
| 5,246,225 | A | | 9/1993 | Matherne et al. |
| 5,305,998 | A | | 4/1994 | Nesbit et al. |
| 5,312,099 | A | | 5/1994 | Oliver, Sr. |
| 5,346,207 | A | | 9/1994 | Heinen |
| 5,374,054 | A | | 12/1994 | Suess |
| 5,480,147 | A | | 1/1996 | Ethier et al. |

(Continued)

*Primary Examiner*—Mitra Aryanpour
(74) *Attorney, Agent, or Firm*—Edell, Shapiro & Finnan, LLC

(57) ABSTRACT

A sports-themed game apparatus convertible from a storage configuration to a deployed configuration, and vice versa is disclosed. The sports-themed game apparatus includes a rim and a defense mechanism operable to move from a first position in which the defense mechanism permits a sports implement to pass through the rim, to a second position in which the defense mechanism prevents the sports implement from passing through the rim. The sports-themed game apparatus may further include a return portion configured to return the sports implement to the user after it is propelled/shot toward the rim.

20 Claims, 32 Drawing Sheets

U.S. PATENT DOCUMENTS

| | | | | |
|---|---|---|---|---|
| 5,536,003 | A | 7/1996 | Brenner | |
| 5,603,496 | A | 2/1997 | Rappaport | |
| 5,692,976 | A | 12/1997 | Yu | |
| 5,765,832 | A | 6/1998 | Huff | |
| 5,813,928 | A | 9/1998 | Hsieh | |
| 5,827,136 | A | 10/1998 | Halter et al. | |
| 5,833,558 | A | 11/1998 | Pettle | |
| 5,842,699 | A | 12/1998 | Mirando et al. | |
| 5,916,048 | A | 6/1999 | Hurell et al. | |
| 6,056,652 | A | 5/2000 | Lees et al. | |
| 6,224,504 | B1 | 5/2001 | Tien | |
| 6,267,696 | B1 * | 7/2001 | Mabe et al. | 473/433 |
| 6,367,948 | B2 | 4/2002 | Branson | |
| 6,458,049 | B2 * | 10/2002 | Bush | 473/433 |
| 6,468,373 | B1 | 10/2002 | Grinwald et al. | |
| 6,554,724 | B2 | 4/2003 | Taylor | |
| 6,565,460 | B2 | 5/2003 | Wang | |
| 6,582,329 | B1 | 6/2003 | Cabrera | |
| 6,620,064 | B2 | 9/2003 | Nickerson | |
| 6,679,498 | B2 | 1/2004 | Barniak, Jr. | |
| 6,913,551 | B1 * | 7/2005 | Foley | 473/448 |
| 6,929,569 | B1 * | 8/2005 | Wang | 473/433 |
| 7,056,237 | B2 * | 6/2006 | Slavey et al. | 473/433 |
| 2003/0030218 | A1 | 2/2003 | Zucchi et al. | |
| 2004/0058756 | A1 | 3/2004 | Huang | |
| 2004/0063521 | A1 | 4/2004 | Oister et al. | |
| 2005/0085320 | A1 * | 4/2005 | Joseph et al. | 473/433 |
| 2006/0040770 | A1 * | 2/2006 | Chou | 473/433 |
| 2006/0154751 | A1 * | 7/2006 | Huntsberger | 473/433 |

* cited by examiner

GAME APPARATUS

FIELD OF THE INVENTION

The present invention relates to a game apparatus and, more particularly, to a sports-themed game apparatus including a game play defense/challenge mechanism.

BACKGROUND

Children can develop motor skills and game playing skills through the use of a sports-themed game apparatus. Typical apparatuses include a stand at which a child can throw, kick, or bat a ball, as well as a receiving area or net that retains the ball within the playing area of the apparatus. These apparatuses, however, are usually constructed for outdoor use (e.g., in a backyard or on a playground). Some indoor, sports-themed game apparatuses have been proposed, but these require a substantial space for their storage and use. In addition, such apparatuses are typically one dimensional, lacking a defensive or challenge component commonly present in live sports game play. There is, consequently, a continuing need for an indoor sports-themed game apparatus that is easily stored, is readily convertible, and is beneficial in developing motor skills and coordination in a growing child. There is also a need for a sports-themed game apparatus that is relatively inexpensive and can be easily assembled, handled, adjusted, and reconfigured.

The present invention is directed generally to a sports game apparatus adapted to convert from a storage mode to a deployed mode and, in particular, to a game apparatus including a target portion, a return portion, and a defense component.

SUMMARY

The present invention is directed toward a sports-themed game apparatus operable to mount on a wall or a door, and, more specifically, toward a game apparatus including a frame that is convertible from a storage configuration to a deployed configuration, and vice versa. The present invention is further directed toward a sports-themed game apparatus including a basketball rim configured to receive a basketball and a defense/challenge mechanism coupled to the basketball rim. The defense/challenge mechanism (hereinafter referred to as the "defense mechanism") is operable to move from a first position in which the defense mechanism permits the basketball to pass through the rim, to a second position in which the defense mechanism selectively prevents the basketball from passing through the rim. The sports-themed game apparatus of the present invention may further include a ball return portion configured to return the basketball to the user after it is shot toward the basketball rim.

BRIEF DESCRIPTION OF THE DRAWINGS

Like reference numerals have been used to identify like elements throughout this disclosure.

DETAILED DESCRIPTION

Figure 1:
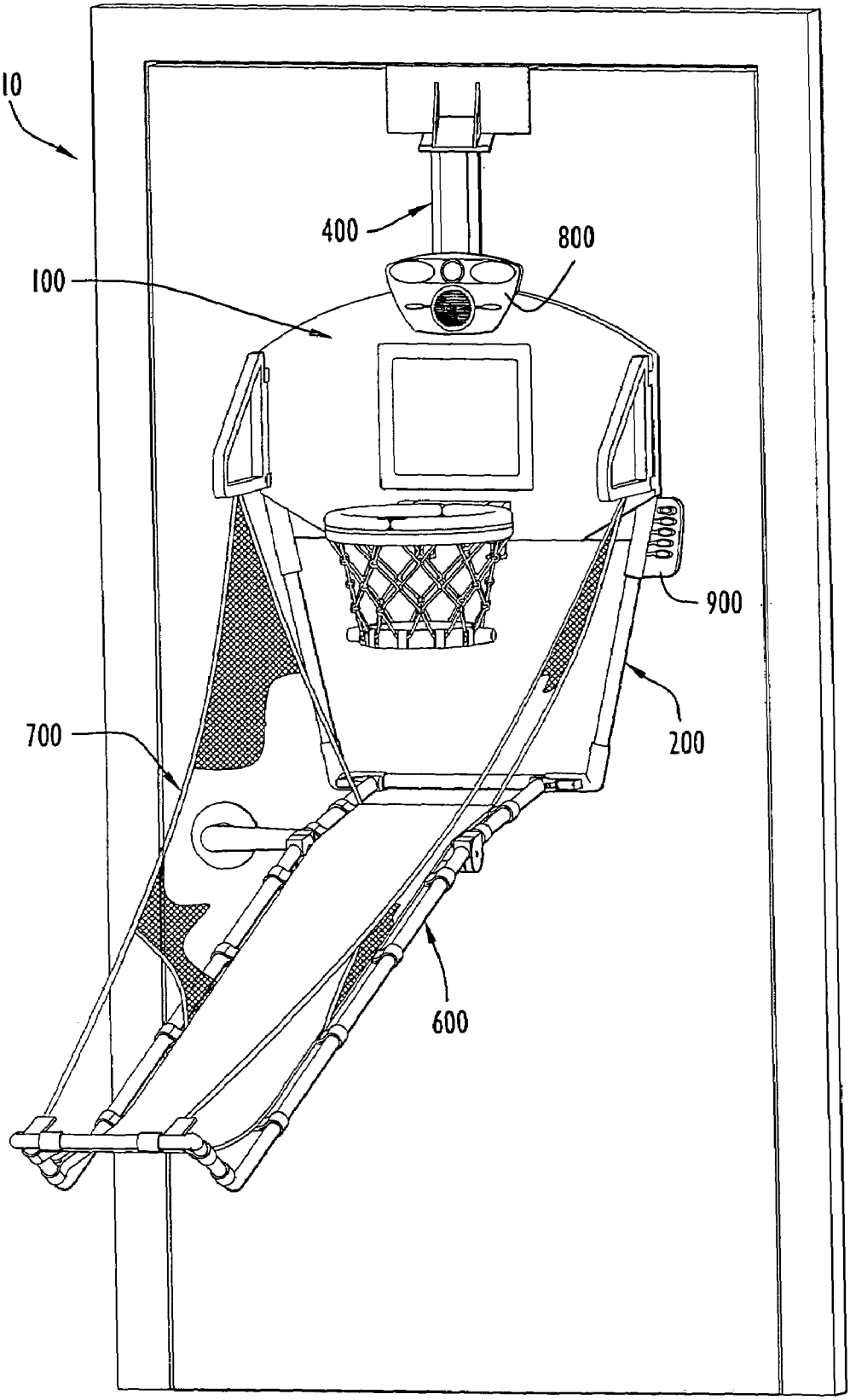
FIG. 1 illustrates a perspective view of a sports-themed game apparatus according to an embodiment of the present invention.

In accordance with the present invention, a door-mountable sports-themed game apparatus including a game play defense mechanism is disclosed. FIG. 1 illustrates a perspective view of the sports-themed game apparatus according to an embodiment of the present invention. As shown, the sports-themed game apparatus 10 includes a target or basketball portion 100, a support frame 200, a mounting (coupling) member 400, and a ball return portion or mechanism 600. In addition, the apparatus 10 may include a one or more sidewalls or containment members 700, a display device or unit 800, and/or a switch box or housing 900.

Figure 2:
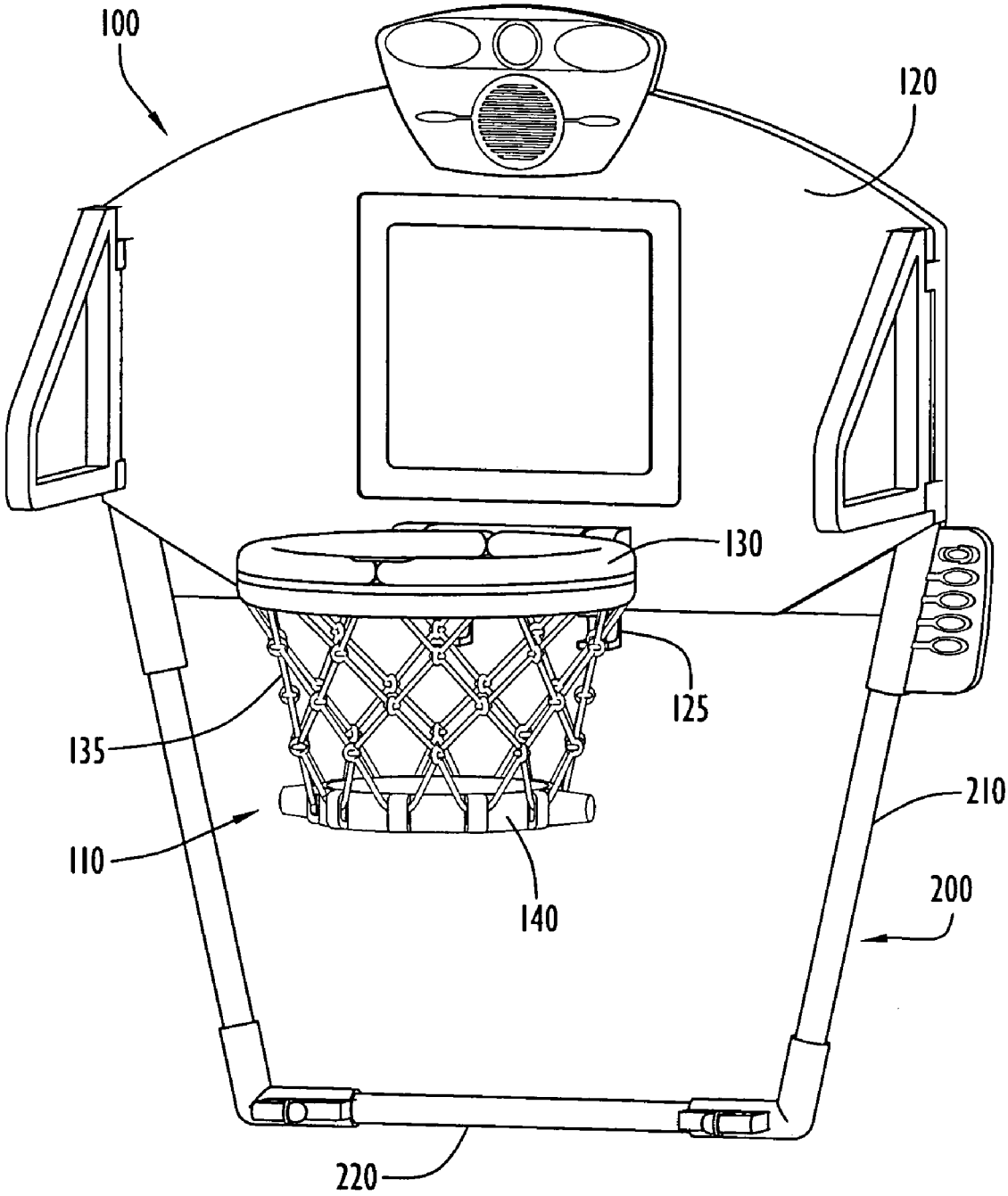
FIG. 2 illustrates a perspective, isolated view of the target portion and the support frame of the sports-themed game apparatus of FIG. 1.

The target portion 100 includes a structure configured to support a target. FIG. 2 illustrates a perspective, isolated view of the target portion 100 and the support frame 200 of the sports-themed game apparatus 10 of FIG. 1. As shown, the target portion 100 may include a target 110 and a panel or backboard 120. In the embodiment shown in FIG. 2, the target 110 comprises a basket configured to receive a sports implement that is shot by a user of the apparatus 10 (e.g., a basketball) (discussed in greater detail below). The target portion 100 is not limited to that illustrated in FIG. 2 and may include targets at which a sports implement is thrown (e.g., a baseball or football) or shot (e.g., a basketball). The general structure of target portion 100 for shot and/or thrown implements may include that disclosed by copending U.S. patent application Ser. No. 11/032,221, entitled Convertible Game Apparatus, the disclosure of which is incorporated herein by reference in its entirety.

The backboard 120 is not limited to any specific construction and may be formed from any suitable material (e.g., rigid plastic). As shown in FIG. 2, the backboard 120 may include one or more securing members 125 extending from the lower edge of the backboard 120. The securing members 125 may comprise C-shaped clasps configured to engage the connector member 675 (see FIGS. 18A and 18B) of the ball return portion 600, and hold the ball return portion 600 in its stored position (discussed in greater detail below). The lower end of the backboard 120 connects to the support frame 200. The support frame 200 includes a structure configured to support the backboard 120 as well as the ball return portion 600. In the embodiment of FIG. 2, the support frame 200 includes two generally vertical posts 210 coupled to the backboard 120 along their upper ends and a generally horizontal post 220 connected to the generally vertical posts 210 along their lower ends. The manner in which the backboard 120 connects to the generally vertical posts 210 may include, but is not limited to, providing the backboard 120 with a pair of vertical channels positioned and sized to receive the generally vertical posts 210 of the frame 200. Alternatively, fastening devices such as clamps or screws may be used to secure the backboard 120 to the generally vertical posts 210. Similarly, clamps or other conventional fasteners may be used to connect the generally vertical posts 210 to the generally horizontal post 220.

As discussed above, the backboard 120 supports a target 110 above a surface (e.g., a floor). The target 110 may comprise any size and shape. In the embodiment of FIG. 2, the target 110 comprises a basket configured to receive a sports implement that is shot by a user. The basket 110 may include a first ring or rim 130 and a second ring or rim 140 positioned below the first ring 130. As illustrated, the second ring 140 may be suspended from the first ring 130 by a net 135. The shape of the rings 130, 140 is not limited to that shown herein, and may include rings having a generally annular shape. Similarly, the size of the rings 130, 140 is not limited to that shown herein. The diameters of the rings 130, 140 are typically sized to permit a basketball of a desired size to pass therethrough. In addition, the first ring 130 and the second ring 140 may have the same or different diameters. Preferably, the diameter of the second ring 140 is smaller than that of the first ring 130. With this configuration, the second (smaller) ring 140 helps to direct the ball toward the return portion 600. In addition, this configuration permits the second ring 140 to nest within the first ring 130. For example, the second ring 140 may be inserted into the first ring 130 for storage (as explained in further detail below). The rings 130, 140 and the net 135 of the target 110 may comprise any suitable material. By way of example, the rings 130, 140 may comprise resilient plastic while the net 135 may comprise fabric mesh.

The target portion 100 may further include one or more sensor elements operable to detect the presence of a basketball in proximity to the target 110. Specifically, a sensor may be positioned within the target 110 to detect the presence of a sports implement within the first ring 130, the second ring 140, or both. The type of sensor is not limited to that shown herein, and may include optical, magnetic, or other electric and/or mechanical sensors. By way of example, at least one optical sensor may be positioned within each of the first and second rings 130, 140. The optical sensors may include an emitter adapted to direct a beam of light across the passageway (the diameter) of the rings 130, 140 to an associated receiver. Consequently, when an object (e.g., a basketball) passes through the rings 130, 140, the light beams are interrupted, closing the switches and generating an output signal. The type of emitter and receiver is not limited to that shown herein. By way of specific example, the emitters may comprise red ultrabright light emitting diodes (LEDs) (sold under the trade name WO5310RUC-SU-DI) and the receivers may comprise CdS photoconductive cells (sold under the trade name KE-15930), both available from Waitrony Co., Ltd., China (www.waitrony.com).

Figure 3:
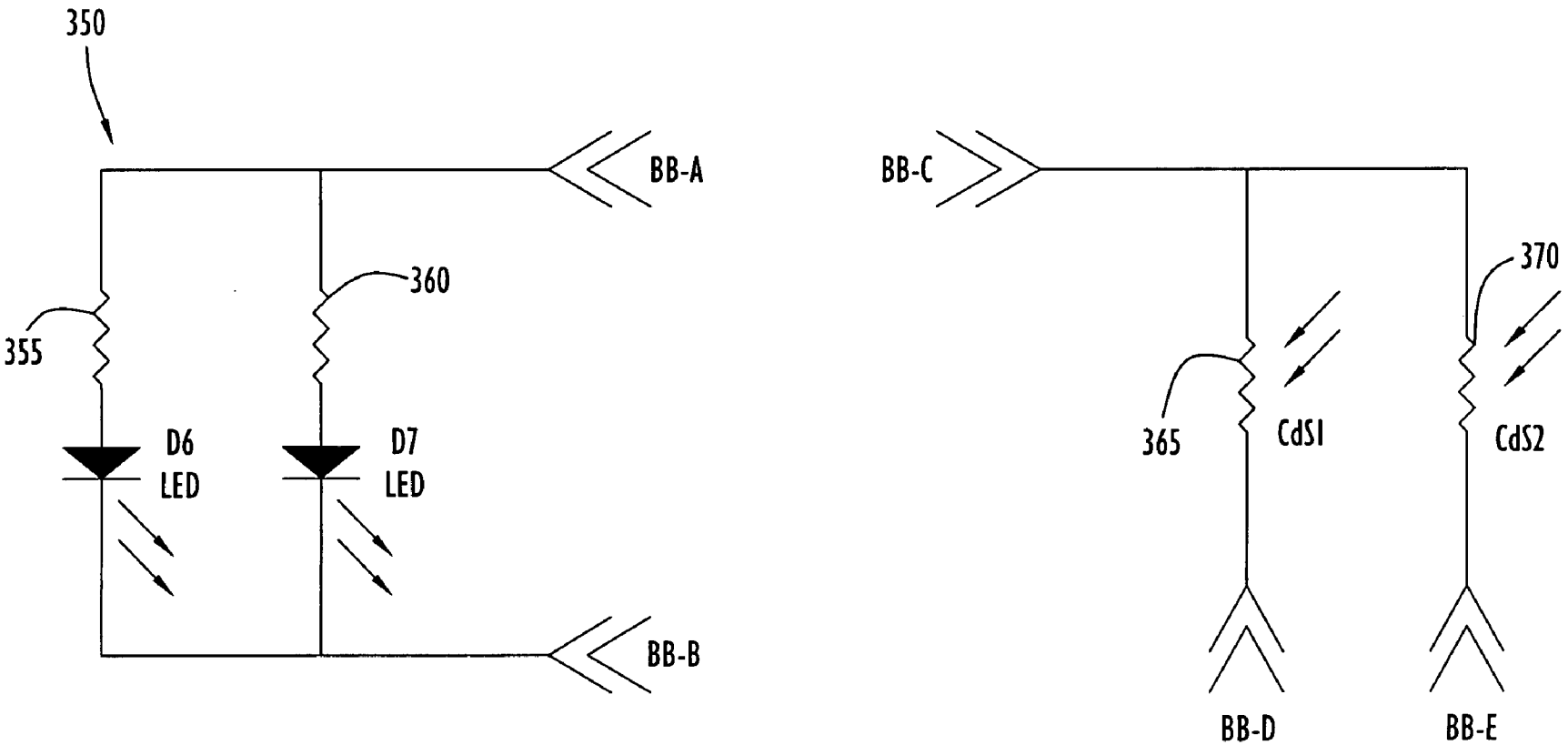
FIG. 3 illustrates a schematic diagram of an electronic sensor configuration appropriate for use with the target (basketball) portion of the sports-themed game apparatus of FIG. 1.

FIG. 3 illustrates a schematic diagram of an electronic sensor configuration appropriate for use with the target (basketball) portion 100. As illustrated, the electronics configuration 350 may include a first LED emitter 355 paired with a corresponding optical receiver 365 and a second LED emitter 360 paired with a corresponding optical receiver 370. Both emitter/receiver pairs 355/365, 360/370 may be operably connected to a control unit (not shown, discussed in greater detail below). The pairs 355/365, 360/370 may be configured to send an output signal to the control unit when either one or both of the light beams produced by emitters 355, 360 is/are interrupted. Specifically, the first emitter/receiver pair 355/365 may be positioned in diametrically opposed relation within the first ring 130 and the second emitter/receiver pair 360/370 may be positioned in diametrically opposed relation within the second ring 140. In operation, a basketball passing through the first and second rings 130, 140 of the target 110 interrupts both beams of light traveling from the emitters 355, 360 to the receivers 365, 370. This interruption of both light beams may generate a signal that is sent to the control unit. The control unit, in turn, may generate appropriate output (e.g., a sound effect, music, increase of displayed score, etc.). In addition, a conventional circuit (not shown) may further be provided to enable and disable the sensors when predetermined parameters are met.

Figure 4A:
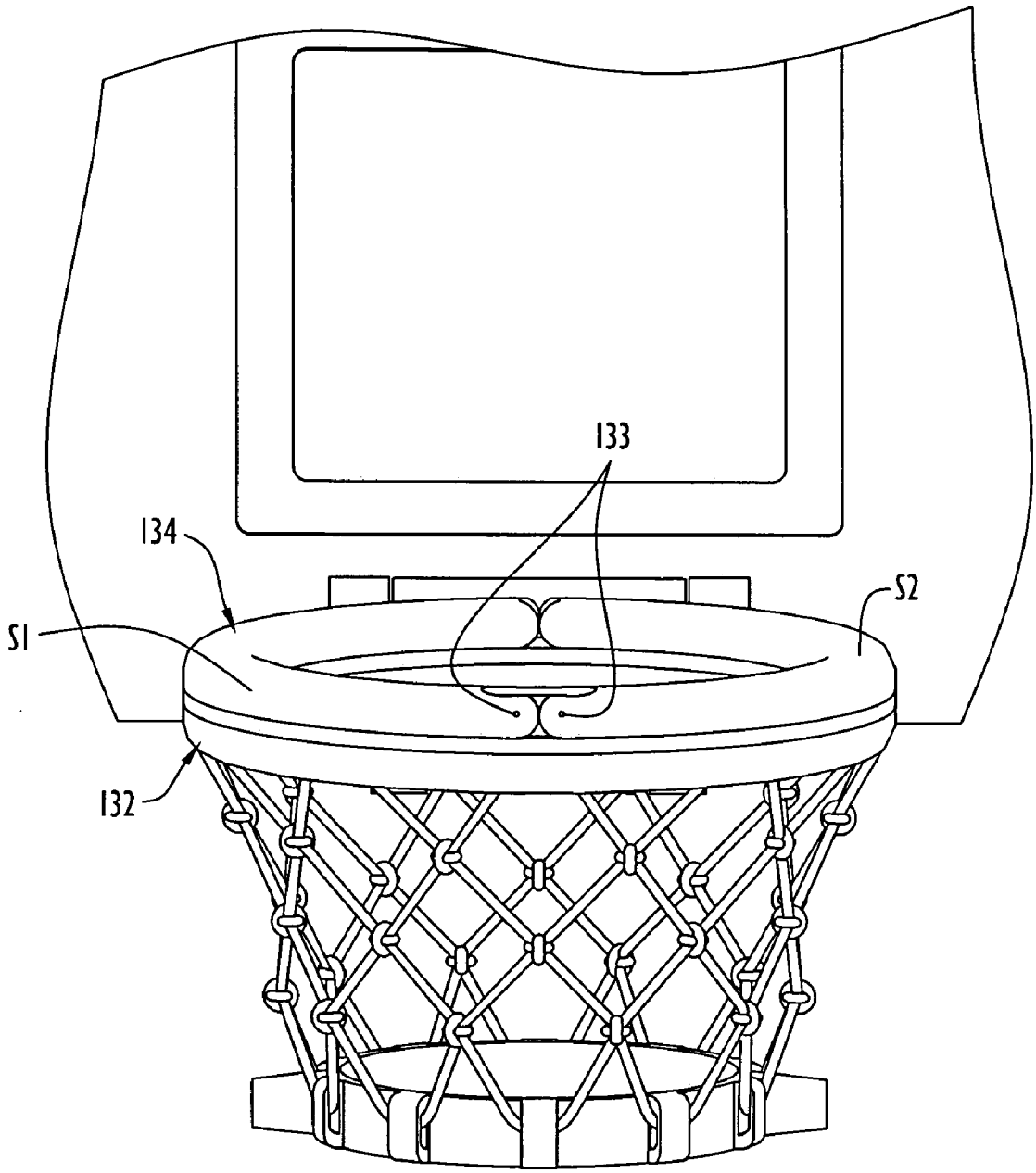
FIGS. 4A and 4B illustrate perspective, close-up views of the basketball rim and defense mechanism of the sports-themed game apparatus of FIG. 1 in both the first and second positions.
Figure 4B:
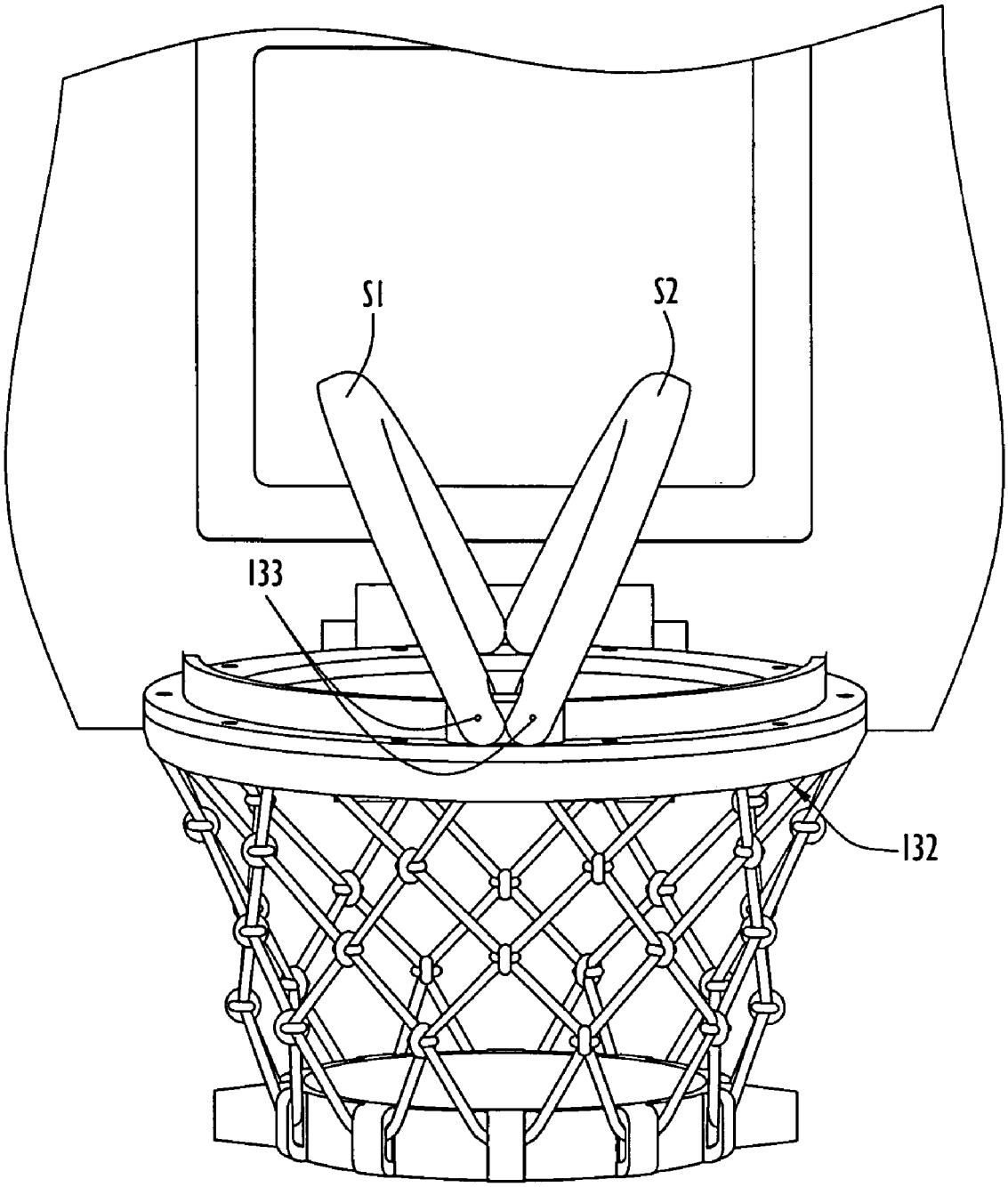

The target portion 100 may also include a game play defense mechanism operable to prevent the passage of the ball through the target 110. FIGS. 4A and 4B illustrate perspective, close-up views of the target 110 of FIGS. 1 and 2, showing the operation of the game play defense mechanism. In the embodiment shown, the first ring 130 may comprise a lower or primary hoop 132 and an upper or secondary hoop 134 superimposed onto the primary hoop 132. The primary hoop 132 may comprise a stationary, one-piece structure. Comparatively, the secondary hoop 134 may include a sectional structure comprising, in the embodiment of FIGS. 4A and 4B, a first section S1 and a second section S2 having substantially equal dimensions and configured as mirror images of each other. Each section S1, S2 may be pivotally secured to the primary hoop 132 at pivot points 133.

Figure 4C:
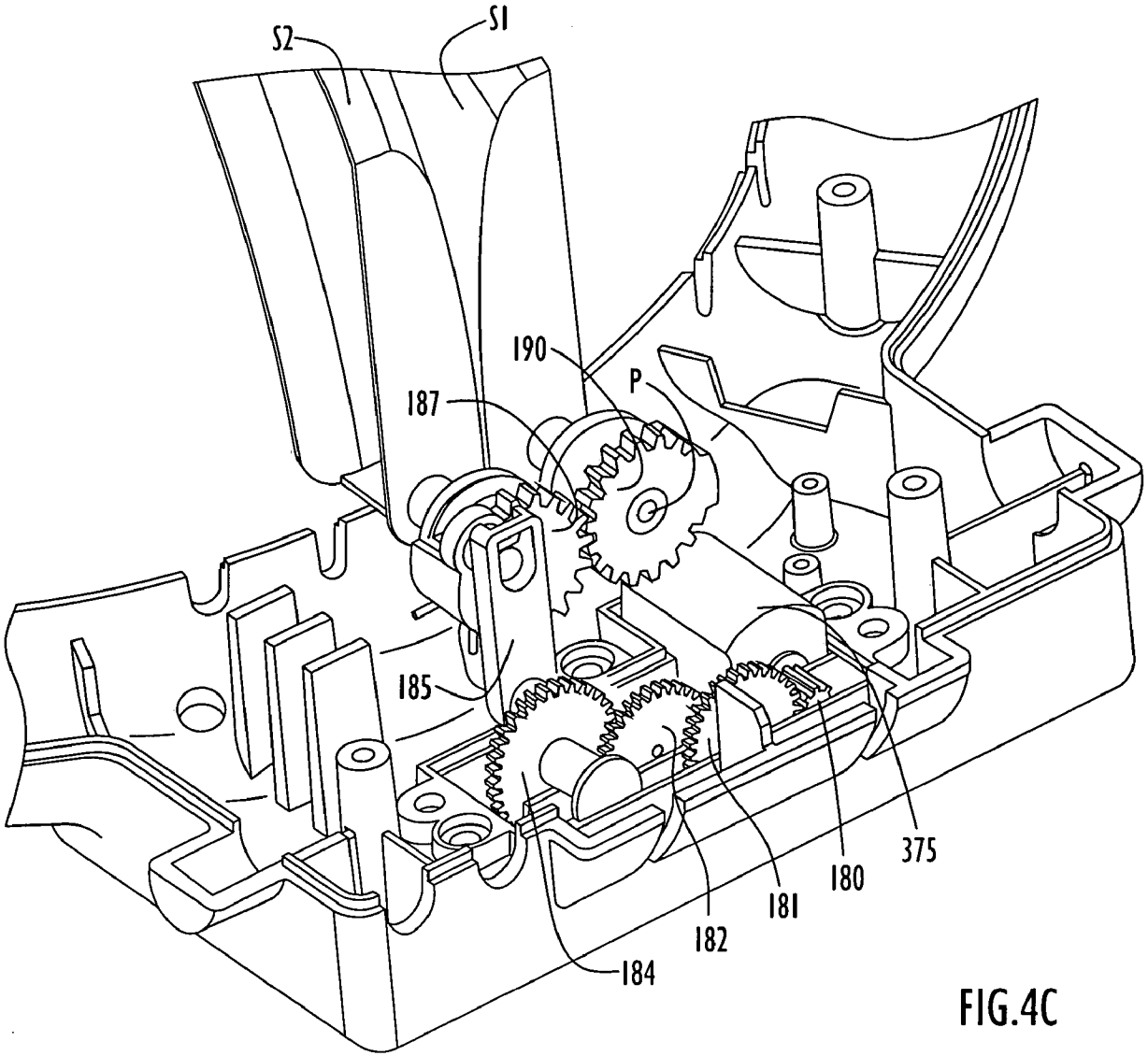
FIG. 4C illustrates an internal view of the basketball rim and defense mechanism of FIGS. 4A and 4B, showing the hoop reorientation mechanism of the sports-themed game apparatus.

As illustrated in FIG. 4B, each section S1, S2 of the secondary hoop 134, furthermore, may be adapted to pivot toward and away from the primary hoop 132. FIG. 4C illustrates an internal view of the first ring 130, showing a hoop reorientation mechanism. The mechanism includes a motor 375 that drives a motor gear 180 meshed with a first cogwheel 181, which, in turn, is meshed with a second cogwheel 182. The second cogwheel 182 is associated (i.e., meshed) with an actuator gear 184. The actuator gear 184 is coupled to a linking member 185 that, in turn, is coupled (in an offset fashion) to a primary drive gear 187. Specifically, the lower edge of the linking member 185 is fixed (in an offset fashion) to the periphery of the actuator gear 184 such that as the gear rotates 360°, the linking member 185 moves up and down. This up and down movement of the linking member 185 further drives the rotation of the primary drive gear 187. The primary drive gear 187 meshes with a secondary drive gear 190. These drive gears 187, 190 are fixed to the pins P of the secondary hoop 134 such that as the gears 187, 190 rotate, their respective pin P rotates, causing the sections S1, S2 to correspondingly rotate. Although not illustrated, the hoop reorientation mechanism may also include a clutch mechanism (e.g., a torsion spring) interposed between drive gears 187, 190 and motor 375 to further insulate motor 375 from sections S1, S2. Thus, the motor 375 will not burn out if a child grabs sections S1, S2 and prevents them from moving.

With this configuration, the sections S1, S2 of the secondary hoop 134 move from a first position, in which the defense mechanism permits the basketball to pass through the rim (also called a "pass through" mode and illustrated in FIG. 4A), to a second position, in which the defense mechanism prevents the basketball from passing through the rim (also called a "shot block" mode and illustrated in FIG. 4B), and vice versa. The operation of the defense mechanism is illustrated with reference to FIGS. 4A, 4B, and 4C. Initially, the sections S1, S2 begin in the first position, with the sections S1, S2 oriented in a normal, horizontal position (the sections are substantially parallel to the primary hoop) (see FIG. 4A). In the first position, the actuator gear 184 begins at its initial orientation, with the linking member 185 at its lowermost (0°/360°) position. The motor 375 is engaged, driving the motor gear 180 and the cogwheels 181, 182. The rotation of the second cogwheel 182 drives the actuator gear 184, causing it to rotate clockwise (from the perspective of FIG. 4C) and moving the linking member 185 from its lowermost (0°/360°) position toward its uppermost (180°) position.

As the linking member 185 moves upward, it drives the primary drive gear 187 clockwise (from perspective of FIG. 4C) causing not only the clockwise rotation of the pin P of the primary drive gear 187, but also the counterclockwise rotation of the secondary drive gear 190 and its associated pin P. Specifically, as the linking member 185 travels from its 0° (lowermost) position to its 180° (uppermost) position, the resulting clockwise rotation of the pin P of the primary drive gear 187 rotates the first section S1 of the secondary hoop 134 clockwise (upward), away from the primary hoop 132. Similarly, the movement of the linking member 185 causes the pin P of the second section S2 to rotate counterclockwise, driving the second section S2 counterclockwise (upward), away from the primary hoop 132. Consequently, when the linking member reaches the 180° (uppermost) position (illustrated in FIG. 4C), the sections S1, S2 are oriented in the second position, with the sections substantially upright (i.e., the sections S1, S2 of the secondary hoop 134 are substantially perpendicular to the primary hoop 132) (see FIG. 4B). In the first/normal position, a ball shot by a user is permitted to pass through the first ring 130 (see FIG. 4A). In the second/upright position, however, the pivoted sections S1, S2 prevent the ball from traveling through the rim (i.e., it "blocks the shot" of a user—see FIGS. 4B and 4C).

As the clockwise rotation of the actuator gear 184 continues, the linking member 185 is pulled downward, causing the primary drive gear 187 to now move counterclockwise. This results in the counterclockwise rotation of the pin P of the primary drive gear 187, which, in turn, causes the first section S1 to pivot counterclockwise (downward), toward the primary hoop 132. Similarly, the secondary drive gear 190 rotates clockwise, driving the second section S2 to pivot clockwise (downward), toward the primary hoop 132. Once the linking member 185 returns to its 0° (lowermost) position, the sections S1, S2 are returned to the first (pass-through) position shown in FIG. 4A. Preferably, the hoop reorientation mechanism pivots the sections S1, S2 in unison. Alternatively, the hoop reorientation mechanism may be adapted to pivot one section S1 or S2 independently of the other (e.g., it may pivot the left section S1 to the upright position, leaving the right section S2 in its normal position) (not shown). Furthermore, the final position of sections S1, S2 in the shot block mode is not limited, so long as it is capable of partially or fully impeding or preventing a sports implement from passing through the first ring 130. That is, orientation of sections S1, S2 other than a generally vertical position, which are sufficient to block and/or deflect the shot, may be used. Similarly, the speed of the pivoting of sections S1, S2 is not limited to that shown herein, and may be selectively altered (via a variable speed motor) to provide varying levels of difficulty.

Figure 5A:
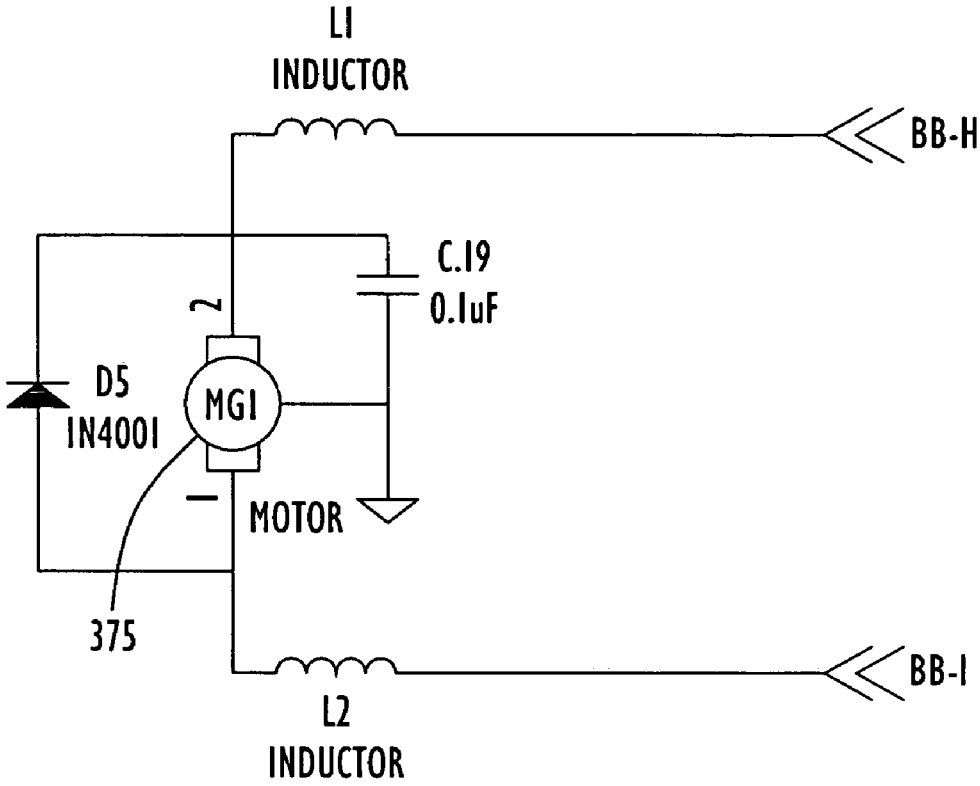
FIGS. 5A and 5B illustrate schematics of the electrical configuration for the game play defense mechanism according to an embodiment of the present invention.
Figure 5B:
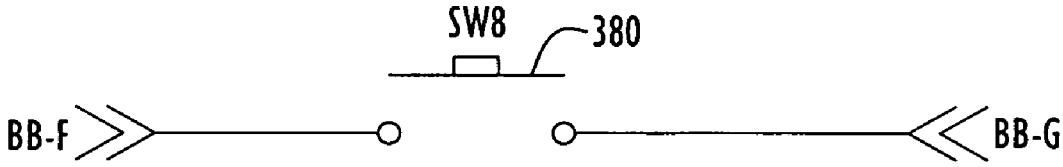

FIGS. 5A and 5B illustrate schematics of the electrical configuration for game play utilizing the defense mechanism according to an embodiment of the invention. Referring to FIG. 5A, the motor 375 may be adapted to selectively engage and disengage the rotation of the pins P and, as explained above, cause the sections S1, S2 to pivot up (away from the primary hoop 132) and down (toward the primary hoop 132). The motor 375 may be associated with a control unit (not shown, discussed in greater detail below) that selectively engages the motor 375, moving each section S1, S2 from the pass through position, upward to the shot block position, and then back down to the pass-through position. Referring to FIG. 5B, the primary hoop 132 may further include a sensor that determines if the sections S1, S2 are oriented in their first/normal position. Specifically, the primary hoop 132 may include a switch 380 (e.g., a mechanical switch) that is engaged whenever the sections S1, S2 are oriented in their normal, horizontal position. When engaged, the switch 380 may be utilized to turn off the motor 375. That is, if the motor starts and the switch 380 is not engaged or released within a desired time frame (e.g., 1.5 seconds), then the motor 375 may automatically turn off. This provides an energy and motor saving mechanism to prevent the use of power (e.g., battery power) and potential motor damage, which might occur if the sections S1, S2 are prevented from unimpeded movement (if an obstruction, such as interference from a user or object, is present). Switch 380 may also be utilized to tell the control unit 860 what position sections S1, S2 are in to product appropriate sound effects (e.g., producing a "shot block" sound output when sections S1, S2 are in the second/upright position).

Figure 6A:
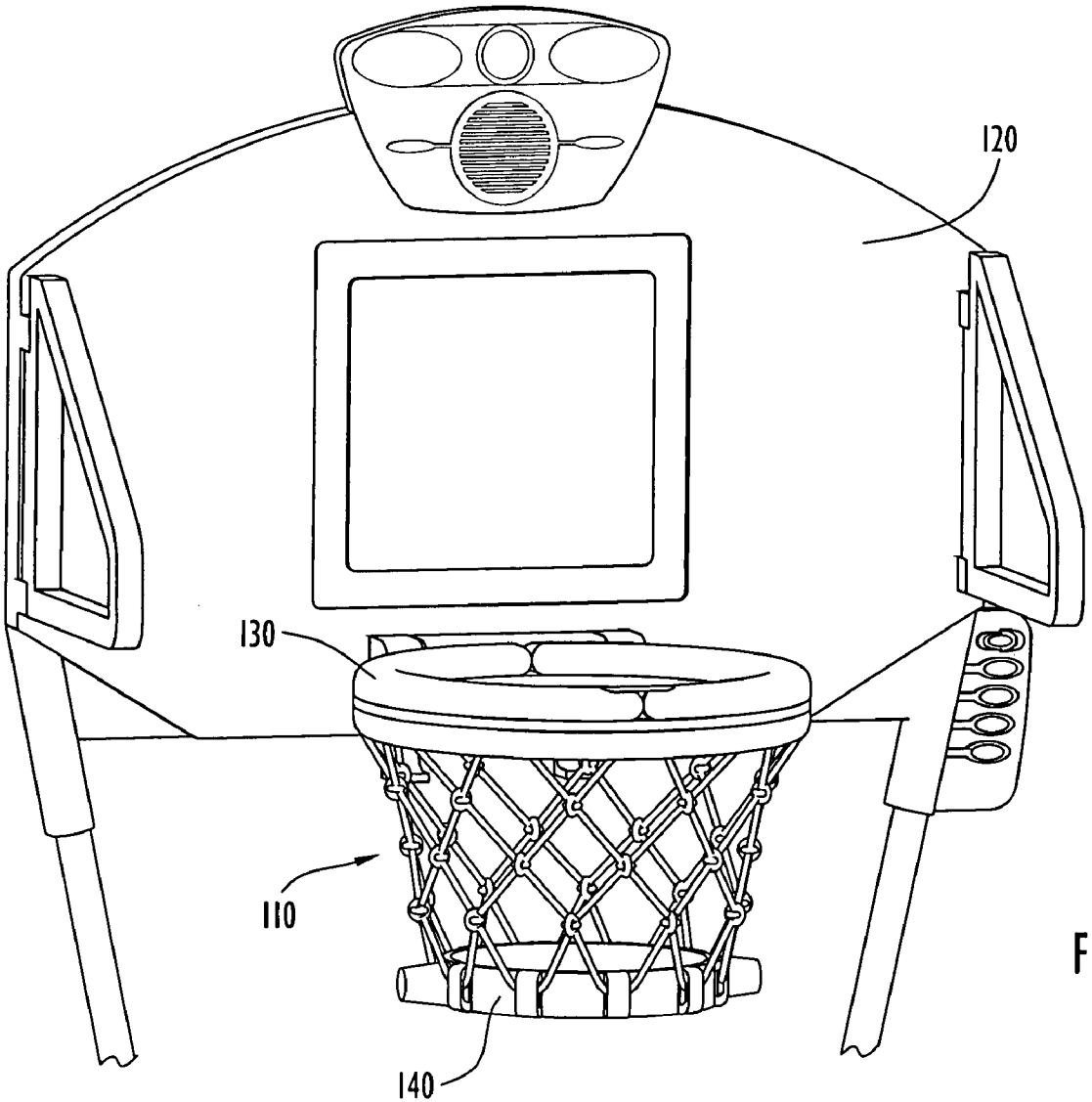
FIGS. 6A–C illustrate perspective, close-up views of the target portion of the sports-themed game apparatus of FIG. 1, showing the folding of the basketball rim.
Figure 6B:
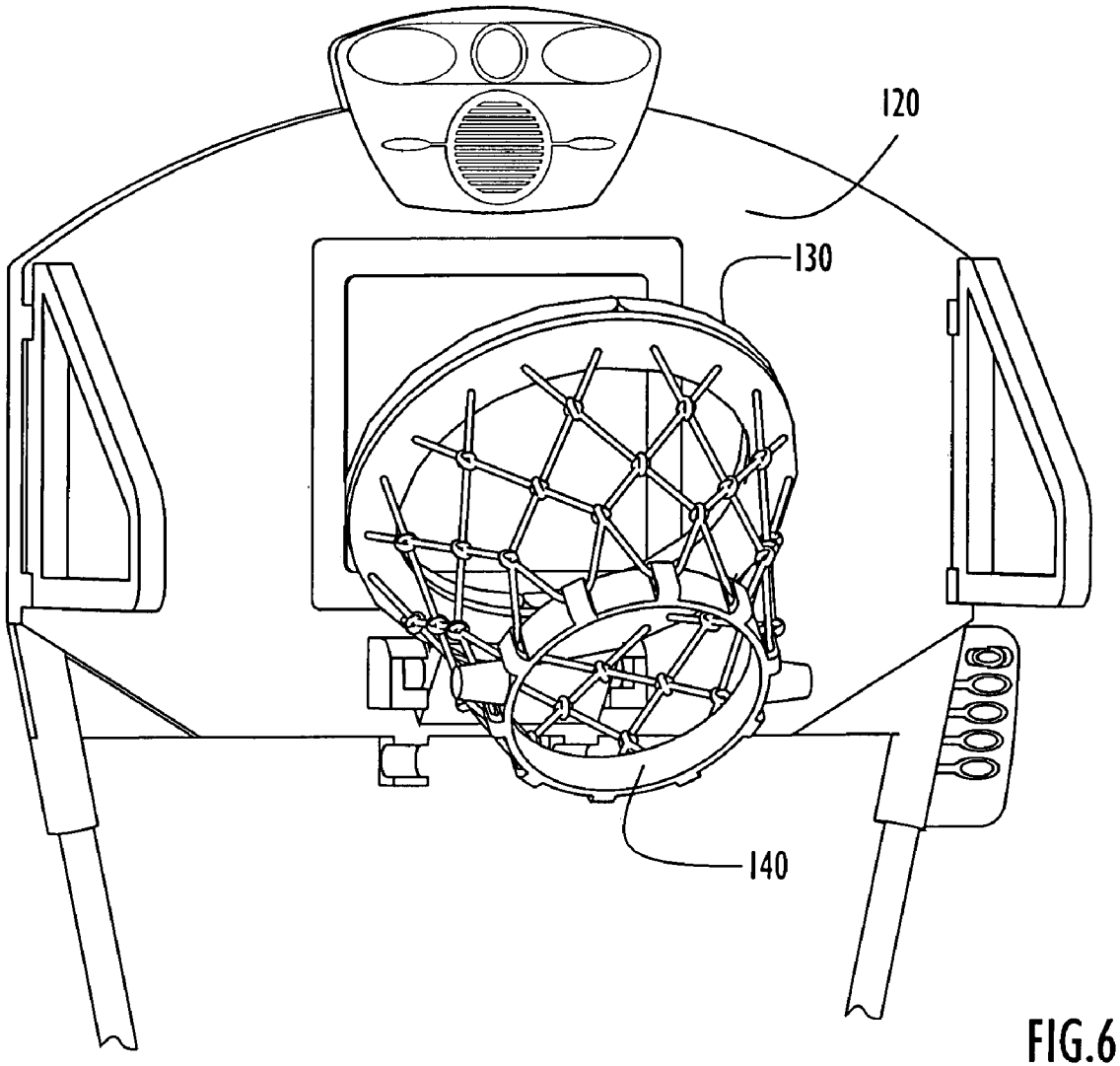
Figure 6C:
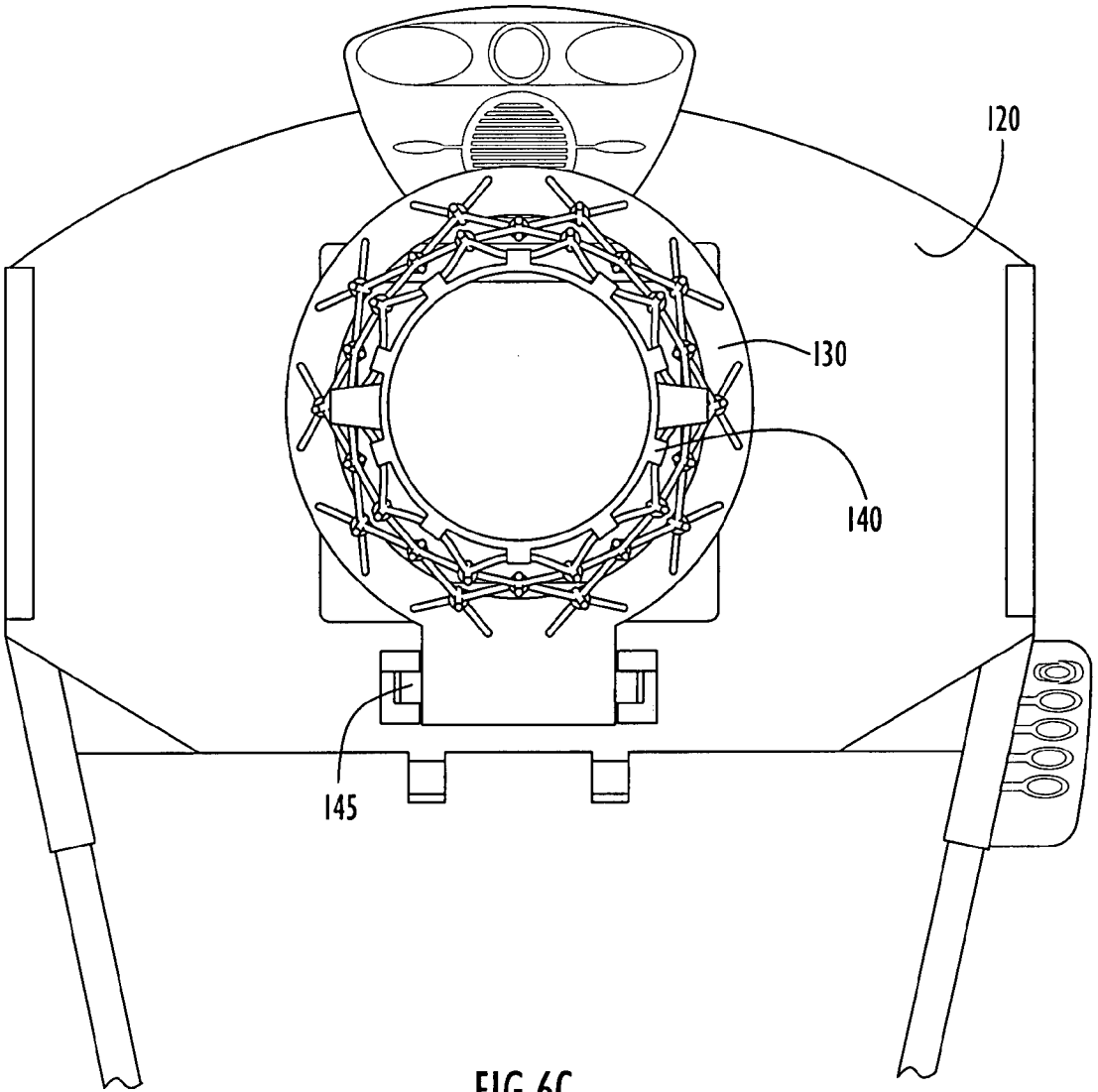

As discussed above, the target 110 is connected to the backboard 120. The connection of the target 110 to the backboard 120 includes, but is not limited to, fixed or hinged connections. By way of specific example, the target 110 may be connected to the backboard 120 to allow its rotation from a substantially vertical orientation to a substantially horizontal orientation (with respect to the supporting surface), and vice versa. FIGS. 6A–C illustrate the method by which the target 110 may be rotated (folded). Specifically, the target 110 may be connected to the backboard 120 via a hinge 145 (best seen in FIG. 6C) that permits rotation of the target 110 with respect to the backboard 120. As a result, the target 110, beginning in its substantially horizontal, deployed position (see FIG. 6A) may be rotated upward (see FIG. 6B) until it contacts the backboard 120 and comes to rest in its substantially vertical, storage position (see FIG. 6C). As shown in FIG. 6C, when the target 110 is oriented vertically, the second ring 140 may be nested inside the first ring 130, providing for more compact storage of the target 110.

Figure 7:
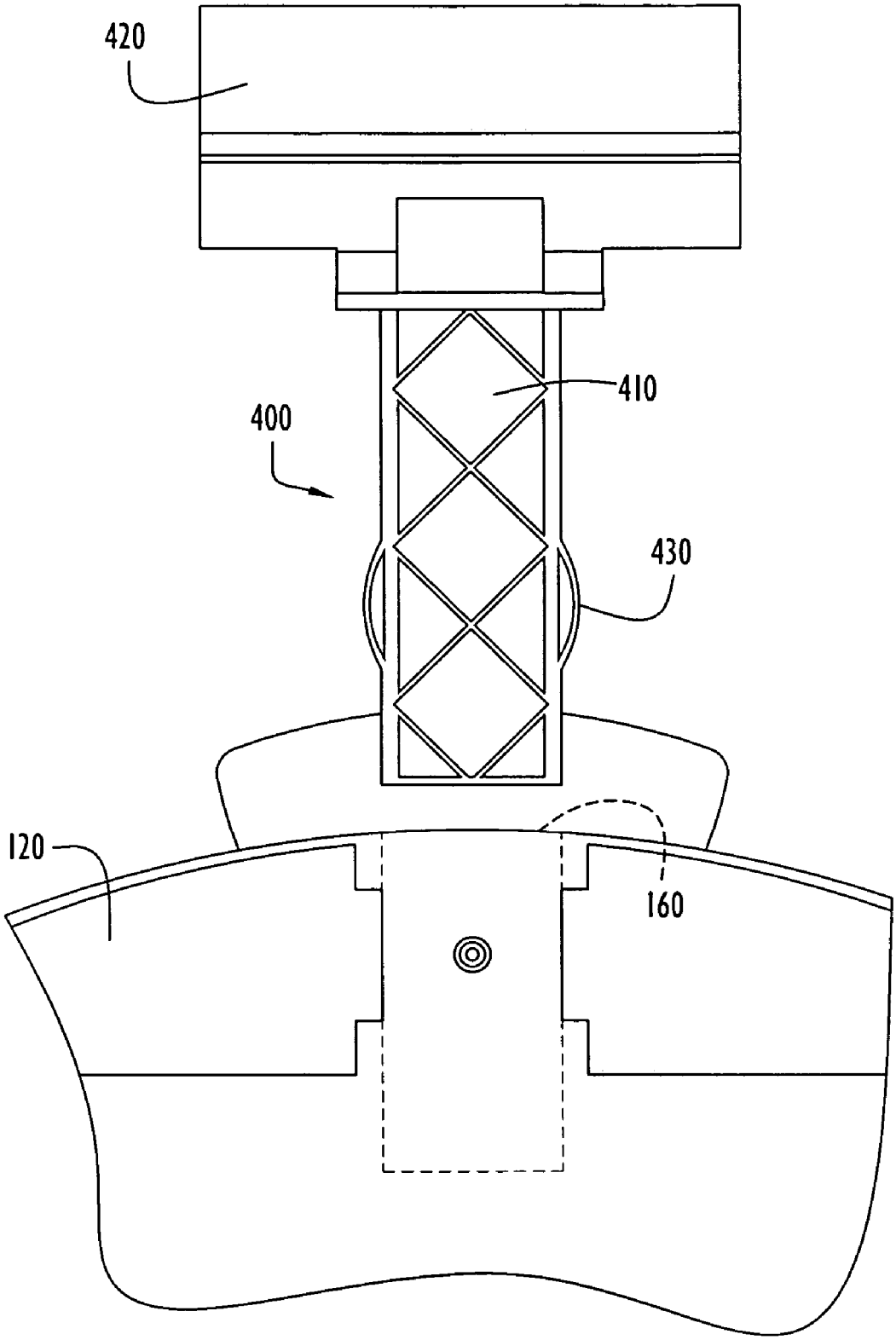
FIGS. 7–9 illustrate the coupling element of the sports-themed game apparatus of FIG. 1 according to an embodiment of the present invention.
Figure 8:
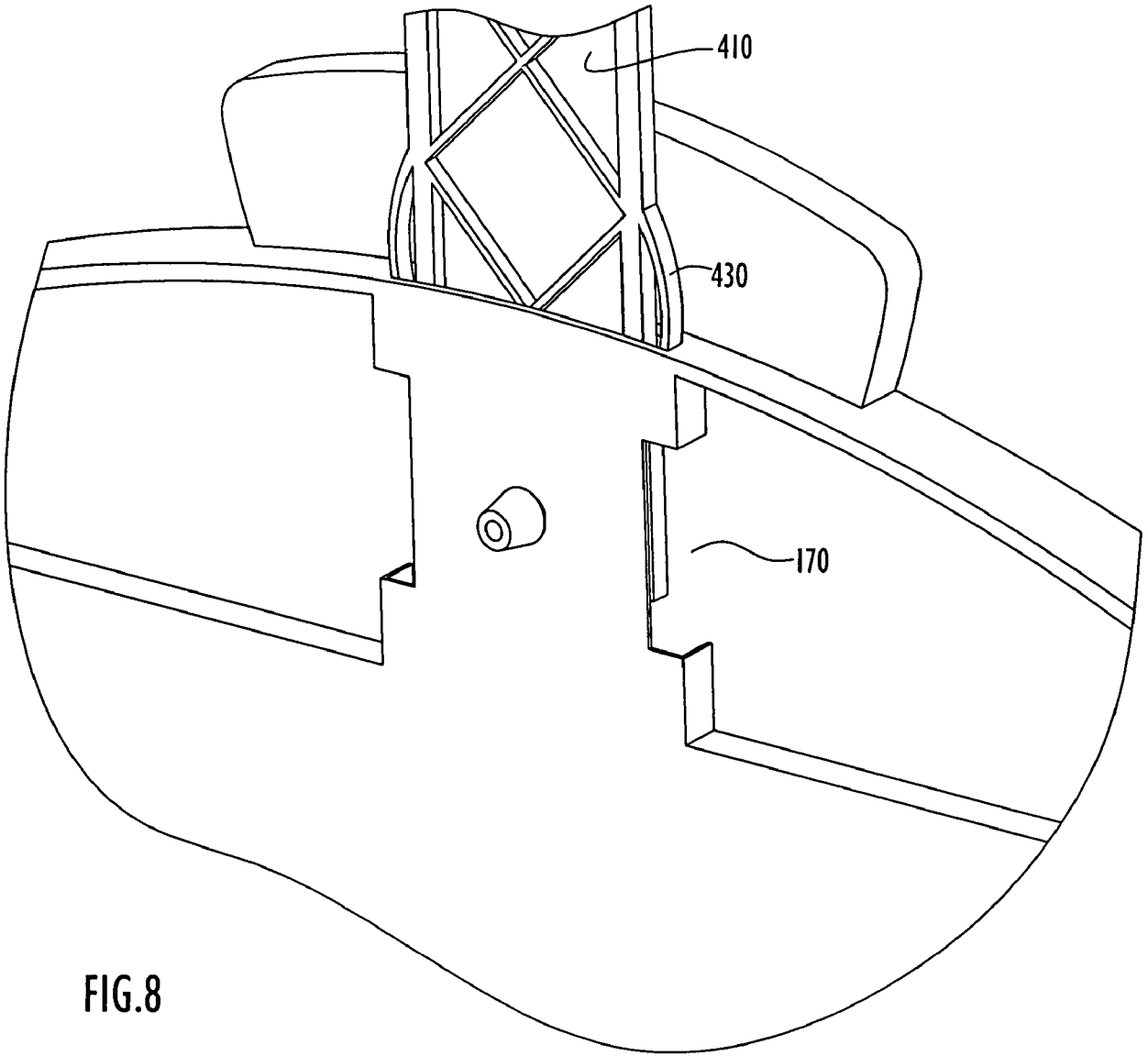
Figure 9:
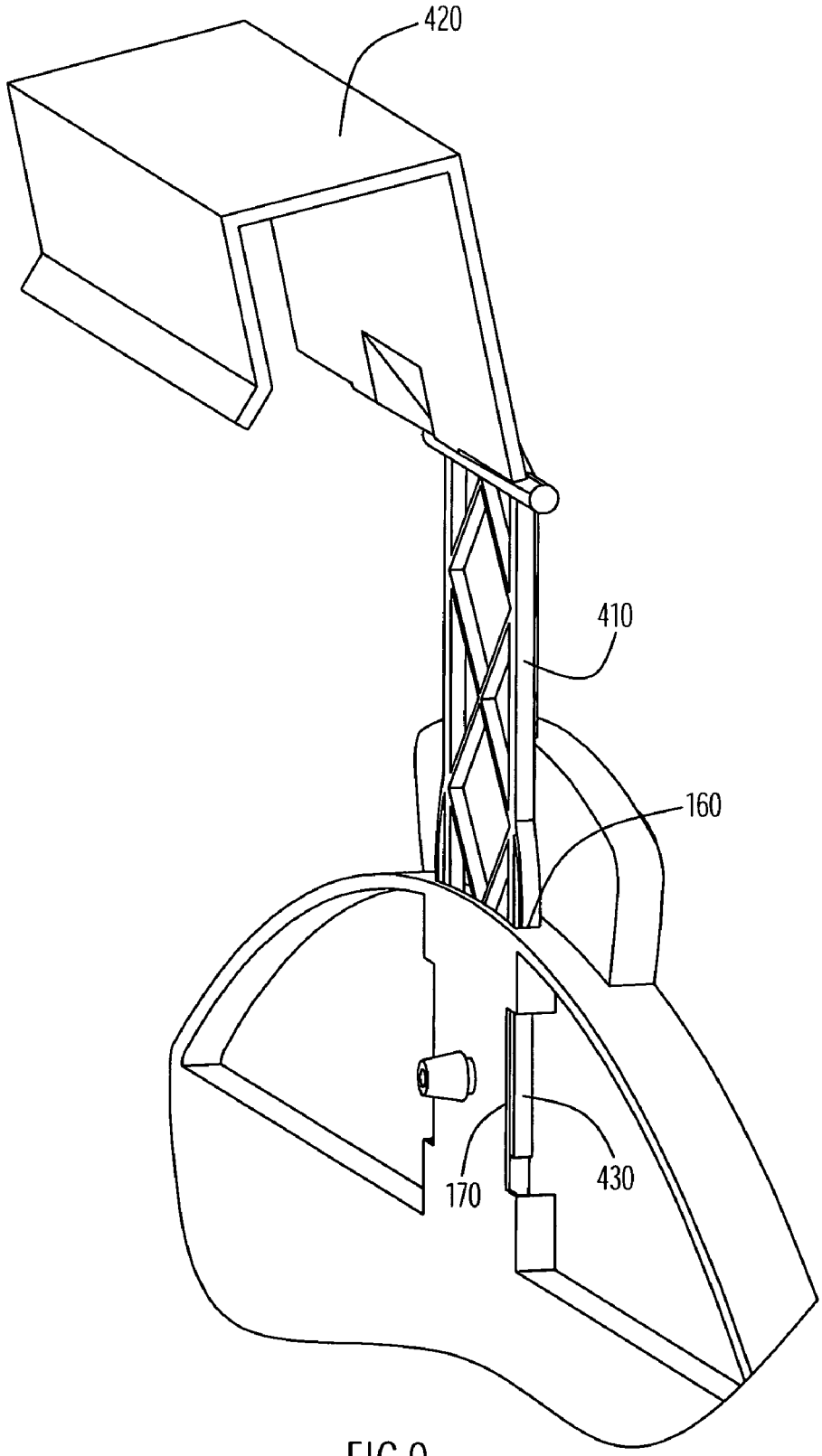

The sports-themed game apparatus 10 may further be adapted to mount to a door or a wall. For example, the backboard 120 may be fastened to a wall using conventional fasteners (e.g., nails or screws). Alternatively, the backboard 120 may be adapted to mount to a structure such as a door. FIGS. 7–9 illustrate a mounting or coupling element 400 suitable for connecting the sports-themed game apparatus 10 to a door such that the apparatus 10 is suspended above a surface (i.e., a floor). Referring to FIG. 7, the coupling element 400 may include a lower post 410 and an upper attachment member 420. The backboard 120, moreover, comprises a channel 160 adapted to receive the post 410. The channel 160 includes one or more slots 170 positioned along the periphery of the channel 160 (best seen in FIGS. 8 and 9). Each slot 170 is configured to receive a resilient tab 430 located on the periphery of the post 410. The tab 430, in turn, is positioned along the post 410 such that, when the post 410 is inserted into the channel 160, a tab 430 aligns with its respective slot 170. Consequently, as illustrated in FIGS. 8 and 9, the post 410 is connected to the backboard 120 by axially inserting the post 410 into the channel 160 (indicated by arrow F). When a tab 430 aligns with a slot 170, the tab 430 (as a result of its resiliency) protrudes through the slot 170, creating a secure, yet removable connection between the post 410 and the backboard 120. Additionally, fasteners such as screws may used to further secure to post 410 within the channel 160. Referring to FIG. 9, the attachment member 420 may comprise a hook configured to fit over a door D to secure it thereon (i.e., it straddles the front and back sides of a door). The configuration of the attachment member 420 is not limited to that shown herein. The attachment member 420 may be fixed to the post 410, or may pivot with respect to the post 410. With the above-described configuration, when the backboard 120 is mounted on a standard door D using the coupling element 400, the target portion 100 (and the apparatus 10) is suspended above a surface, with the back side of the backboard 120 and the support frame 200, resting against the door D (seen in FIGS. 1 and 10).

Figure 10:
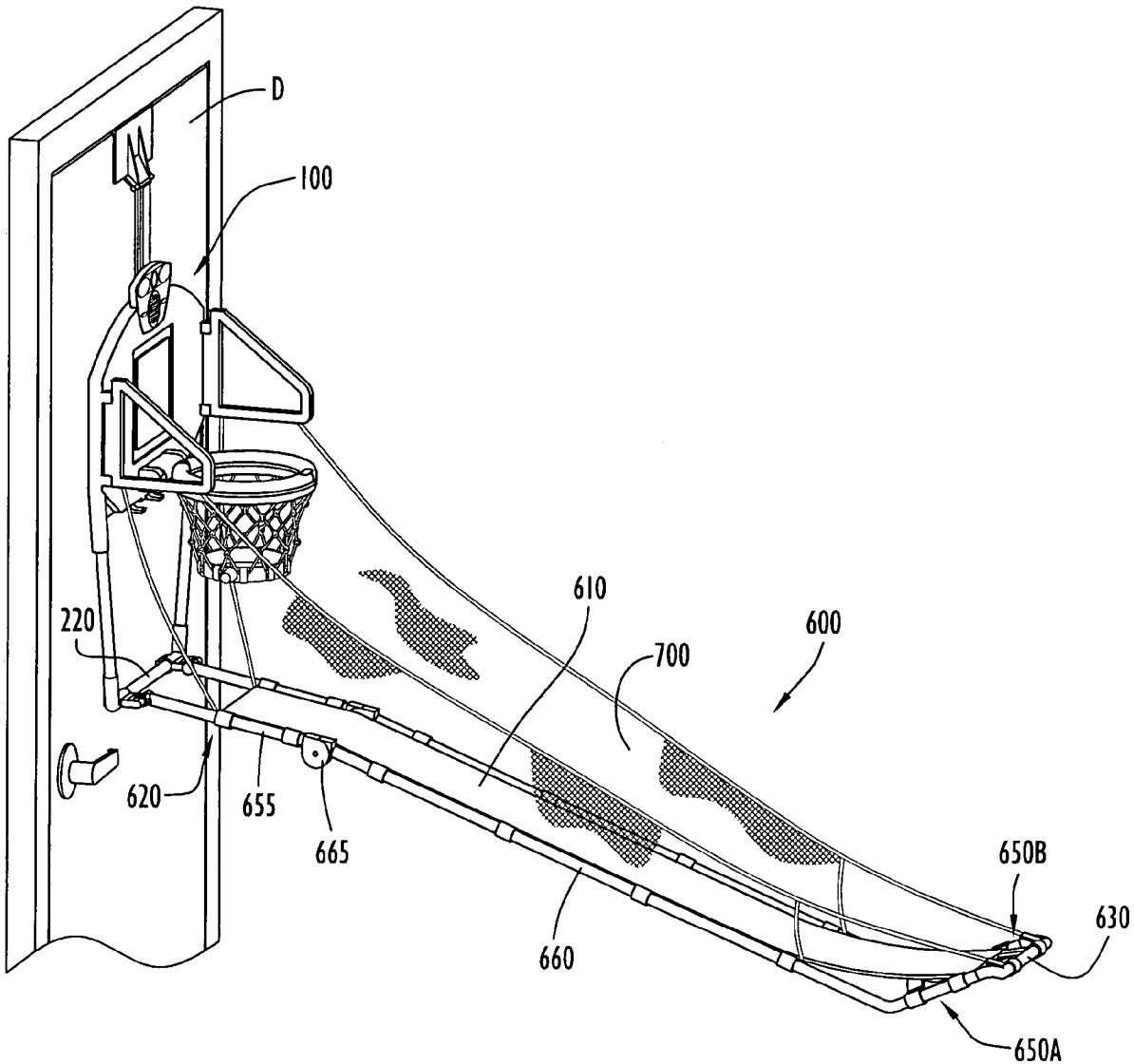
FIG. 10 illustrates a side view of the return portion of the sports-themed game apparatus of FIG. 1.

The return portion 600 of the sports-themed game apparatus 10 includes a structure configured to direct a shot sports implement back to a user from the target portion 100. The return portion 600 may be coupled to the support frame 200 through the horizontal post 220. FIG. 10 illustrates a side view of the return portion 600 of the sports game apparatus 10 of FIG 1, showing the apparatus mounted on door D. In the embodiment of FIG. 10, the return portion 600 includes a chute 610 and a support structure 620. The chute 610 defines a passageway for the return of the sports implements. Preferably, the chute 610 comprises an open-top structure that declines as it travels from the backboard 120 (i.e., away from the door D) to enable gravity to direct a sports implement back toward a user positioned at the other end of the chute 610 (discussed in greater detail below). The material comprising the chute 610 may include, but is not limited to, flexible material to enable its folding. By way of example, the chute 610 may comprise woven and/or non-woven fabrics (e.g., canvas or polyester).

The chute 610 may be connected to the chute support structure 620 using conventional means, including, but not limited to, hook and loop fasteners. The chute support structure 620 is adapted to support the chute 610 and permit the conversion of the return portion 600 from a deployed configuration (illustrated in FIG. 10) to a folded configuration and vice versa. The design of the chute support structure 620 is not particularly limited to that illustrated herein. In the embodiment of FIG. 10, the chute support structure 620 includes a first pole 650A and a second pole 650B extending from the ends of the horizontal post 220. The end of the chute support structure 620 opposite the horizontal post 220 may comprise a U-shaped handle 630 (also called an end cap). By way of specific example, the support structure 620 may comprise extruded poles made of three tubular sections and a tubular, U-shaped end cap.

Figure 11:
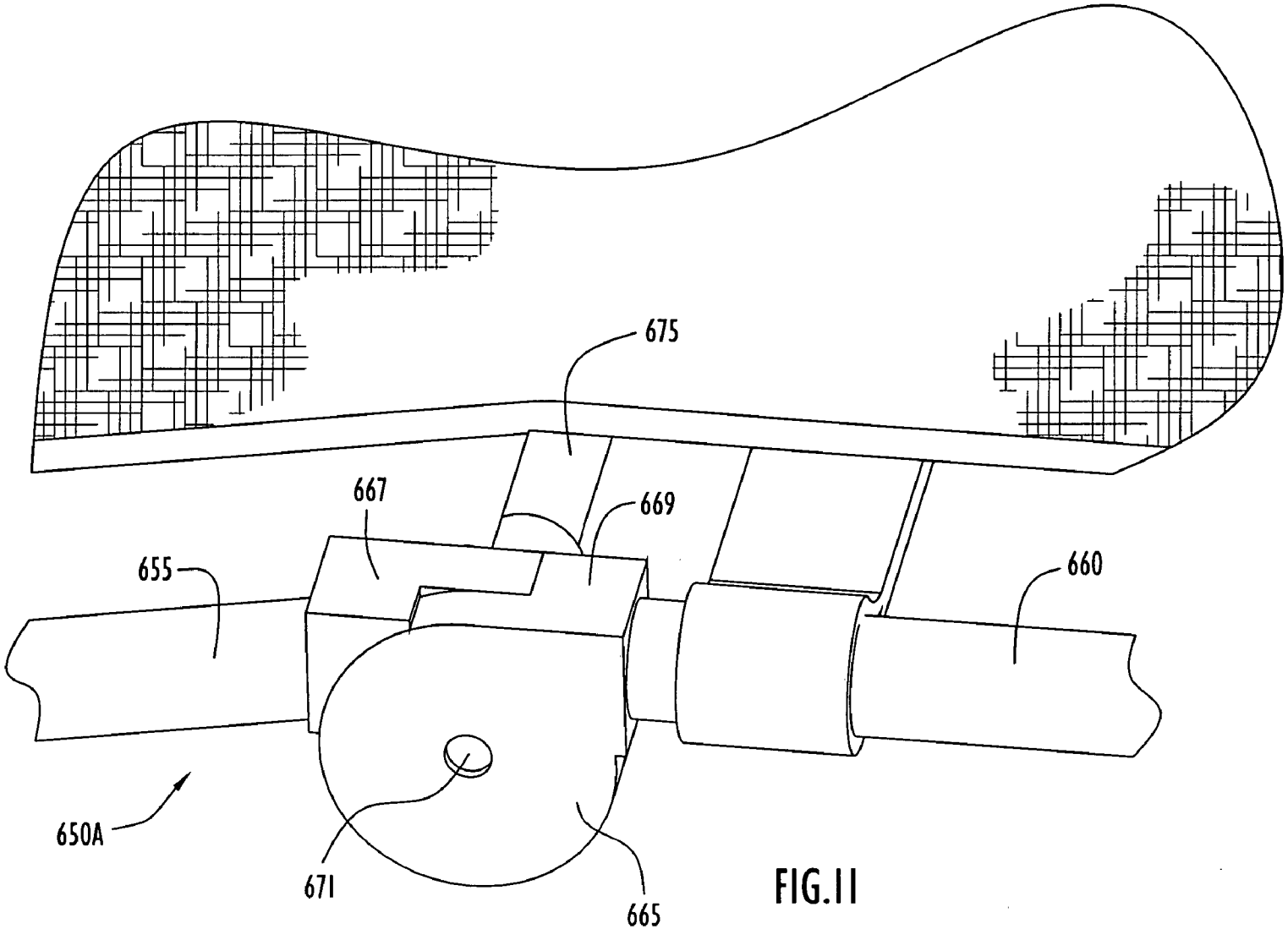
FIG. 11 illustrates a close-up view of the pivot joint of the sports-themed game apparatus of FIG. 10.

Each pole 650A, 650B of the chute support structure 620 is segmented, including a rear section 655 connected to a front section 660 via a pivot joint 665 adapted to rotate one segment with respect to the other. FIG. 11 is a close-up view of the pivot joint 665 of FIG. 10. As illustrated, the pivot joint 665 comprises an inner portion 667 (which extends from the rear section 655) connected to an outer portion 669 (which extends from the front section 660) via a pivot post 671. One or both of the inner and outer portions 667, 669 may turn freely about the post 671 in any desired degree of rotation. Preferably, the pivot joint 665 comprises an 180° pivot joint where the outer portion 669 rotates with respect to the inner portion 667. Specifically, the outer portion 669 (and thus the forward section 660 of the first chute pole 650A) may be configured to rotate clockwise 180° (from the viewpoint of FIG. 11) from a position in which the front section 660 is substantially collinear with the rear section 655, to a position in which the sections 655, 660 are not aligned, e.g., where the front section 660 is generally non-collinear, becoming parallel to the rear section 655 (not shown in FIG. 11, best seen in FIGS. 17A and 17B). The pivot joint 665 of the second chute pole 650B operates in a similar manner. In addition, the pivot joint 665 of the first chute pole 650A may connect to the pivot joint 665 of the second chute pole 650B through a connector member 675 (seen best in FIG. 12) to provide additional support to the chute structure 620. The connector member 675 may be removably connected to the pivot joints 665. For example, the internal surface of the inner portions 667 may comprise a recess (not shown) into which the connector member 675 slides, becoming secured within the recess in the internal surface of the inner portions 667 of the pivot joints 665 via friction. The pivot joint 665 is not limited to the embodiment of FIGS. 10 and 11, and may include any mechanism suitable to provide folding action (rotation between one or both of the front and rear sections 655, 660).

Figure 12:
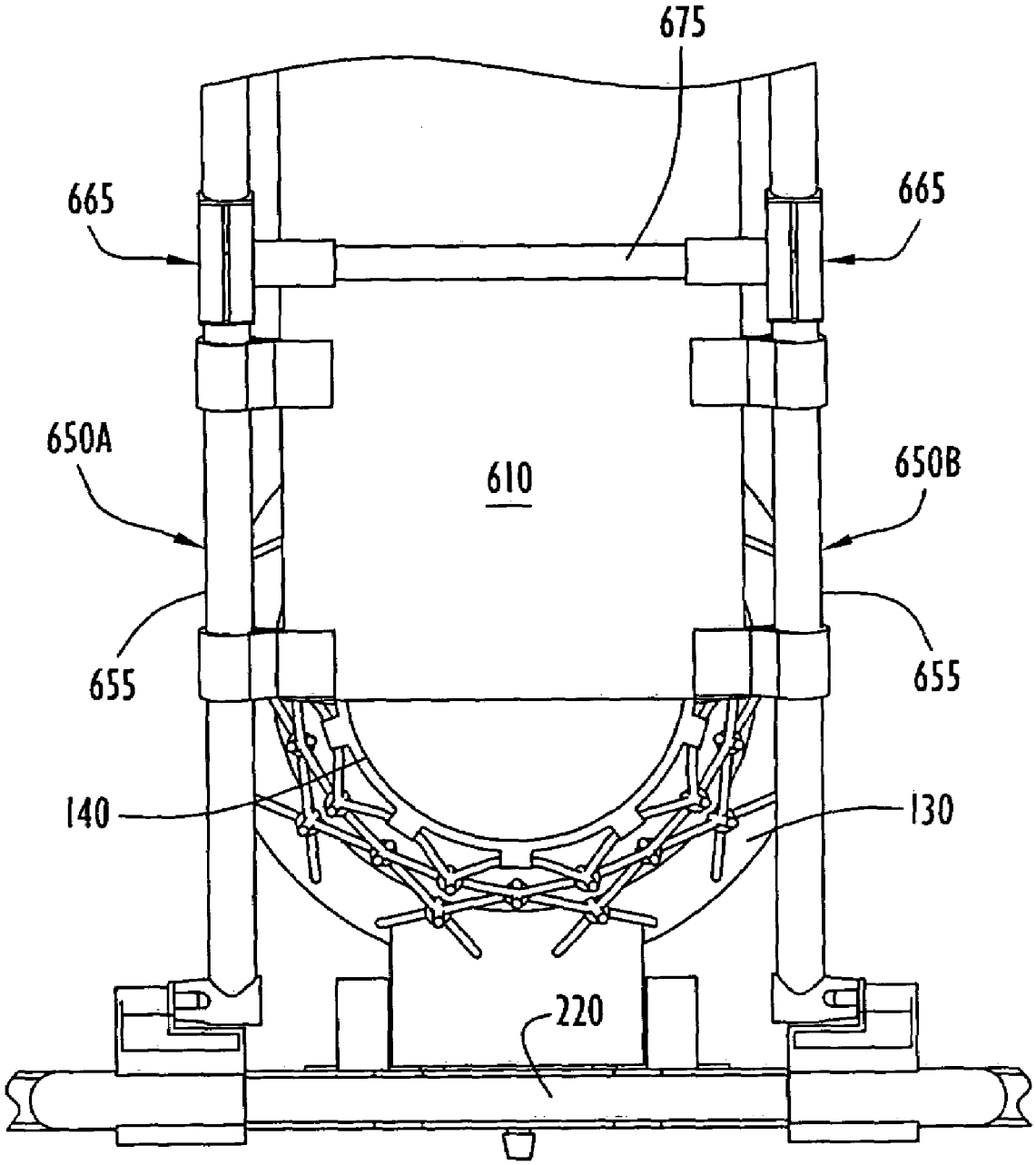
FIG. 12 illustrates a close-up, bottom view of the sports-themed game apparatus of FIG. 10, showing the chute support structure.
Figure 13A:
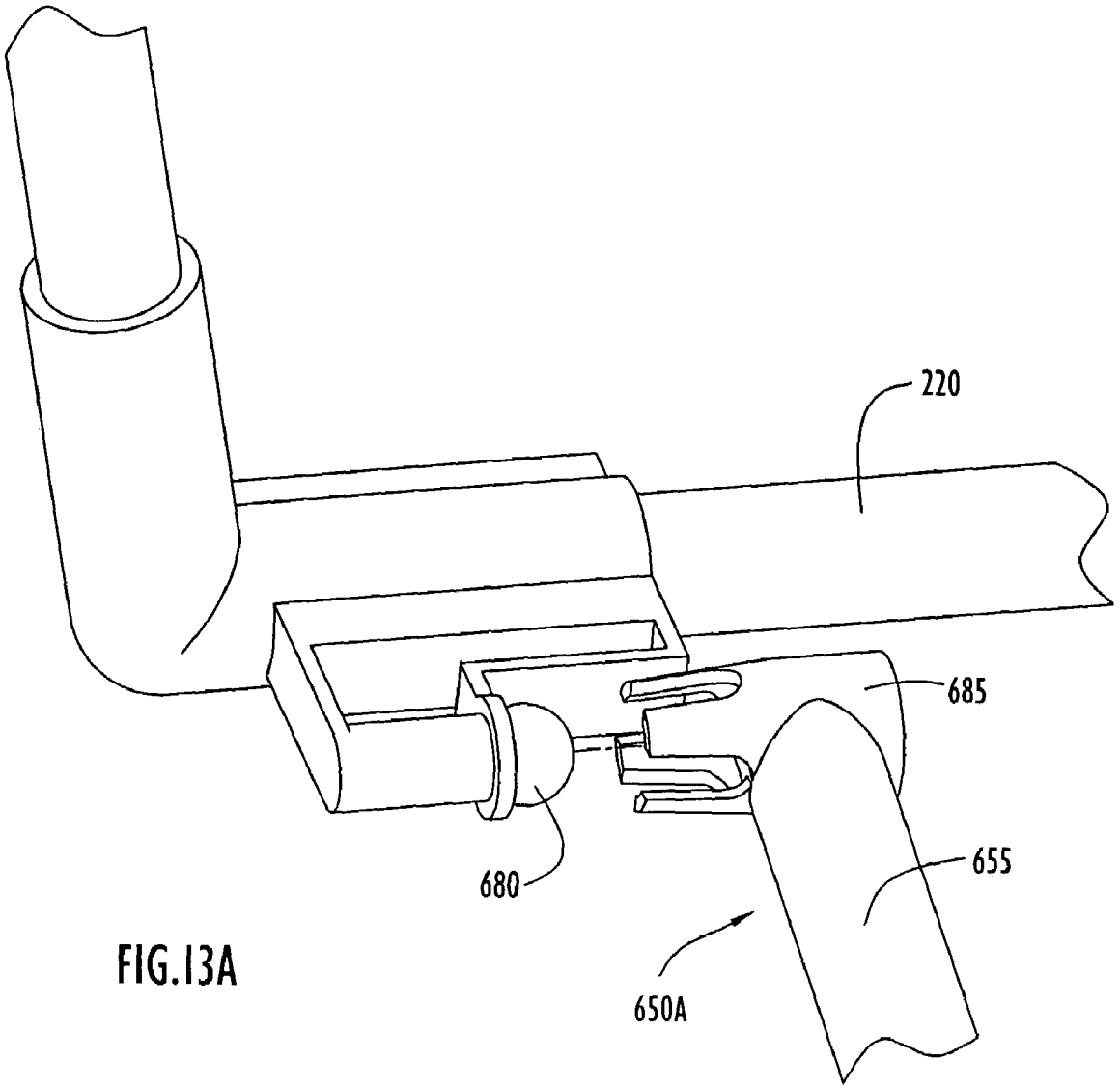
FIGS. 13A and 13B illustrate close-up views of the ball-and-socket connection of the sports-themed game apparatus of FIGS. 1 and 10.
Figure 13B:
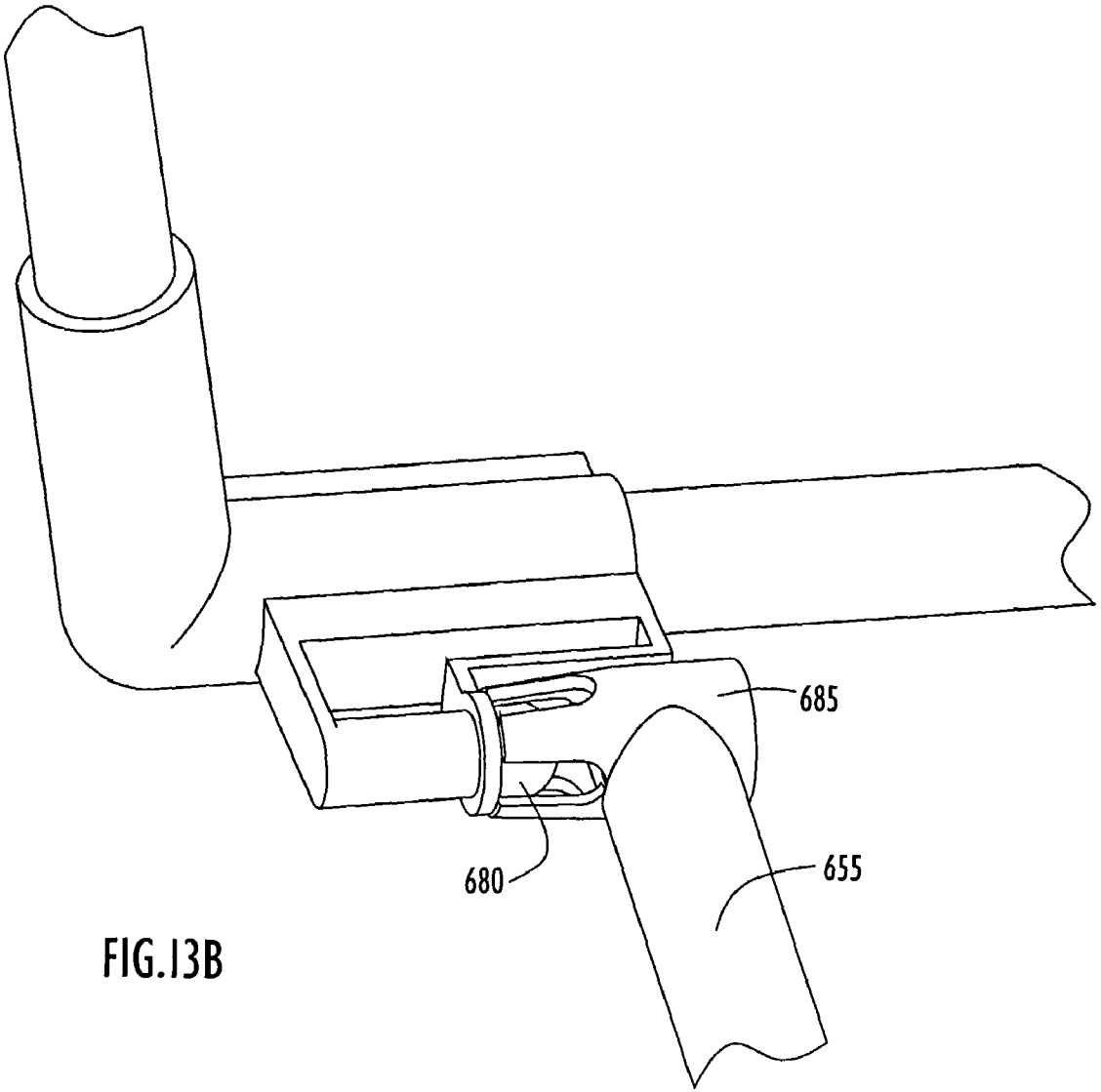

In addition to folding, the chute support structure 620 may rotate with respect to the support frame 200. FIG. 12 is a bottom view of the sports-themed game apparatus of FIG. 10, showing the support structure. As discussed above, the connector member 675 couples the pivot joint 665 of the first chute pole 650A to the pivot joint 665 of the second chute pole 650B. The rear sections 655 of the poles 650A, 650B, furthermore, are rotatably coupled to the horizontal post 220 of the support frame 200. Specifically, the rear pole sections 655 are connected to the horizontal post 220 via a ball-and-socket connection. FIGS. 13A and 13B illustrate the ball-and-socket connection of the apparatus of FIGS. 1 and 10. As shown, the horizontal post 220 supports a ball joint 680, while the first rod 650A comprises a socket 685 configured to receive the ball joint 680 and permit the rotation of the joint 680 within the socket 685. With this configuration, the socket rotates about the ball 680, enabling the rotation of each rod 650A, 650B, which, in turn, enables the rotation of the support structure 620. Preferably, the ball-and-socket connection is configured to permit the rotation of the rear section 655 from a position where it is substantially perpendicular to the support frame 200 (see FIG. 10) to a position in which the rear section 655 is substantially parallel to the support frame 200 (see FIG. 18A).

In addition, the ball joint 680 may be disconnected from the socket 685 when a predetermined amount of force is applied to the connection. As seen best in FIG. 13A, the ball joint 680 may be adapted to separate from the socket 685 when a force of a given magnitude is applied to the chute support structure 620. That is, when a predetermined force is applied, the socket 685 pulls away from/out of the ball 680; consequently, the connection terminates and the entire chute support structure 620 to separates from the support frame 200. This provides a safety feature—the ball return 600 "breaks away" and falls to the floor in the event the door is suddenly opened (while the ball return is in its deployed (extended) position) in a way that causes the ball return 600 to be pushed toward the door (e.g., by contacting the user, a nearby wall, or a nearby piece of furniture). In addition should a user attempt to hang, sit on, or fall into the return portion 600, the break-away feature of the return portion will be engaged. To reconnect the return portion, the sockets 685 are axially inserted over (snapped over) the ball joints 680 (the connected ball and socket arrangement is best seen in FIG. 13B).

As discussed above, and referring back to FIG. 10, the end of the chute 610 positioned closest to a user terminates at the handle structure 630. The handle 630 is configured to capture sports implements traveling down the chute 610, as well as to maintain the chute poles 650A, 650B parallel to each other. The handle 630 may comprise a handlebar with a 45°, inverted U-shaped member that connects to the front section 660 of the chute poles 650A, 650B. Alternatively, the handle 630 may comprise an upper bar and a lower bar oriented parallel to the upper bar, wherein the chute connects to the lower bar and the upper bar serves as a handle (not shown). The handle 630 may be adapted to serve as a stop mechanism for the sports implements, preventing their rolling off the end of the chute 610. The handle 630 may also serve as a gripping member to assist a user in manipulating the return portion 600 (e.g., to deploy or fold the chute, as discussed in greater detail below), as well as serve as a connection point for the chute 610. The method of connecting the chute 610 to the handle 630 is not limited to that which is illustrated herein. By way of example, the chute 610 may be removably connected to the handle 630 via one or more resilient C-shaped clamps (shown but not identified with a reference numeral) or hook and loop fasteners.

Figure 14:
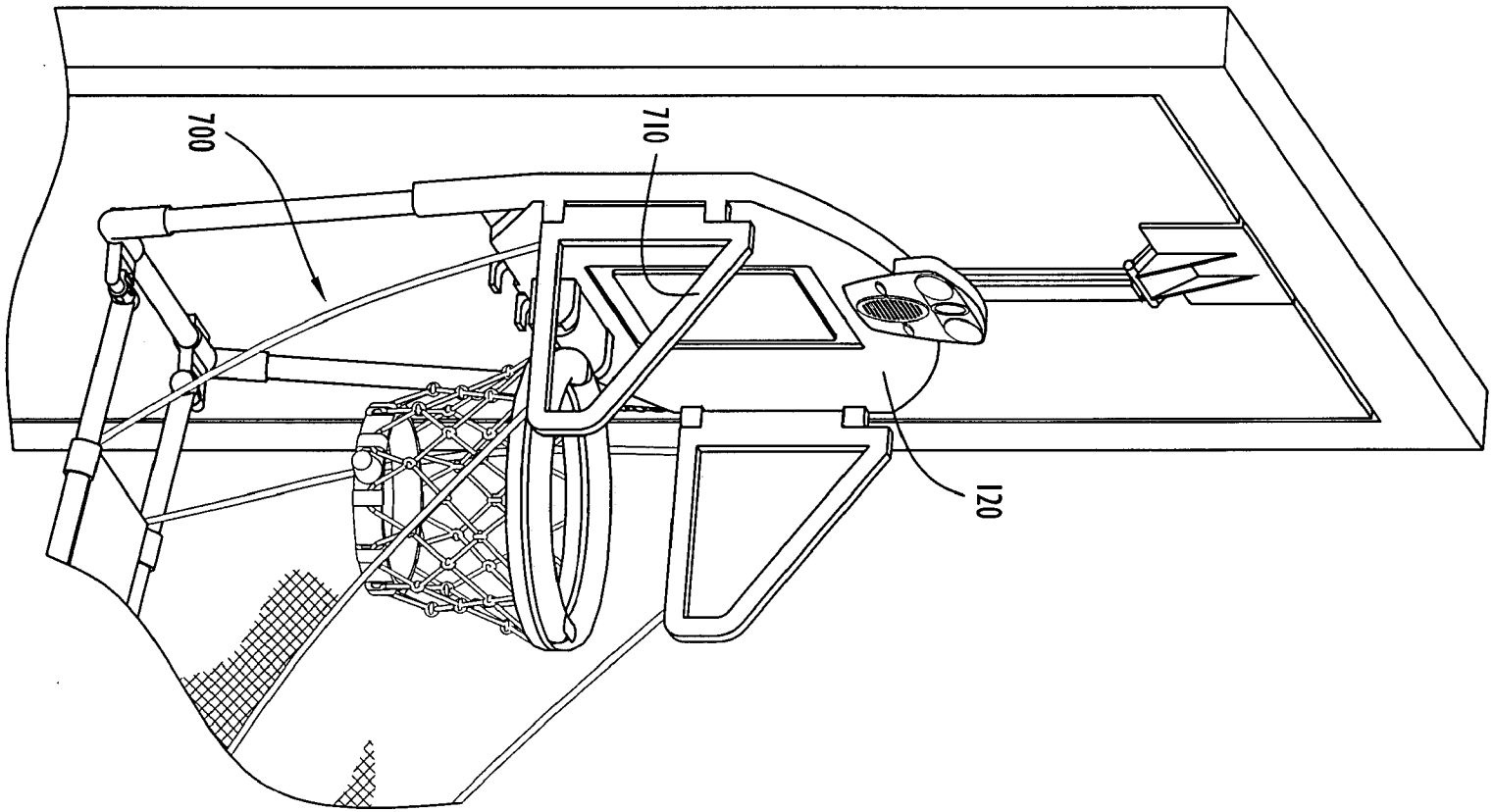
FIG. 14 illustrates a close-up view of the target portion of the sports-themed game apparatus of FIGS. 1 and 10, showing the connection of the containment members to the backboard.

The ball return 600 may further comprise containment members or sidewalls 700 running along the sides of the return portion 600 that are capable of maintaining the sports implements in proximity to the target portion 100 and directing the implements toward the chute 610. Still referring to FIG. 10, the sports-themed game apparatus 10 may include sidewalls 700 comprising a fabric (e.g., fabric mesh) positioned on each longitudinal side of the chute 610. Consequently, the sidewalls 700 will tend to deflect the balls back into the chute 610. FIG. 14 illustrates a close-up view of the target portion 100 of FIGS. 1 and 10, showing the connection of the sidewalls 700 to the backboard 120. As shown, the sidewalls 700 may connect to the backboard 120 via sidewall brackets 710. The sidewall brackets 710 may be hinged to the outer (left and right) edges of the backboard 120 such that the sidewall brackets 710 pivot horizontally (about a vertical axis), toward and away from the backboard 120 and the target 110. With this configuration, the sidewall brackets 710 are reconfigurable, and can be folded from a deployed position (shown in FIG. 14) to a storage position (shown in FIG. 20).

Each sidewall 700 may extend from its respective sidewall bracket 710 and along a side of the chute 610 of the sports implement/ball return portion 600. The sidewalls 700 may extend partially along the chute (e.g., terminating at a point short of the handle 630 as shown in FIG. 10), or may be coextensive with the chute 610 (not shown). In addition, the sidewall brackets 710 may be adapted to separate from the backboard 120 when a predetermined amount of force is applied (e.g., a force sufficient to separate the chute support structure 620 from the frame 200).

Figure 15:
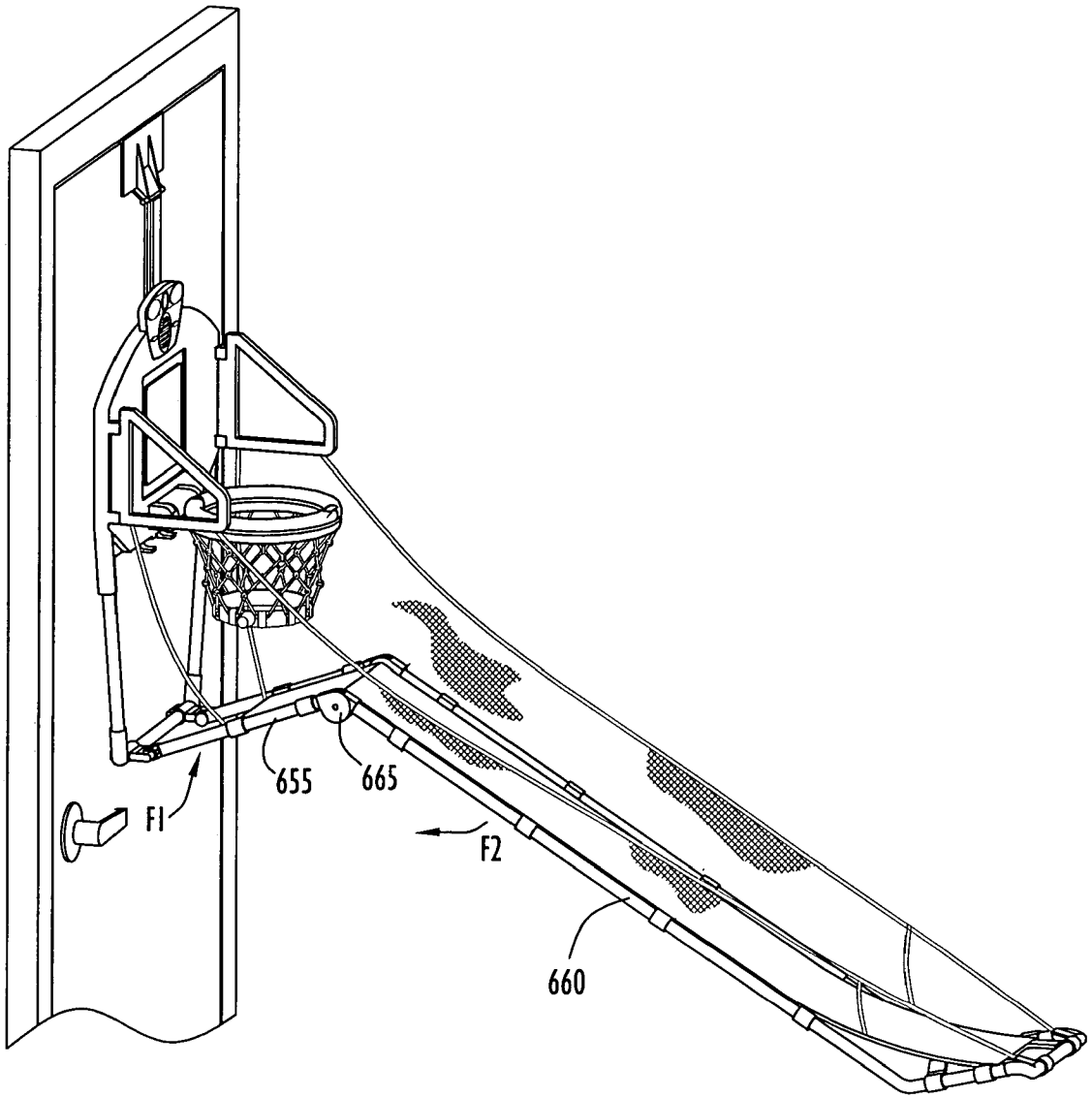
FIGS. 15, 16, 17, 18A, 18B, 19, and 20 illustrate the conversion of the sports-themed game apparatus from a deployed configuration to a stored configuration.
Figure 16:
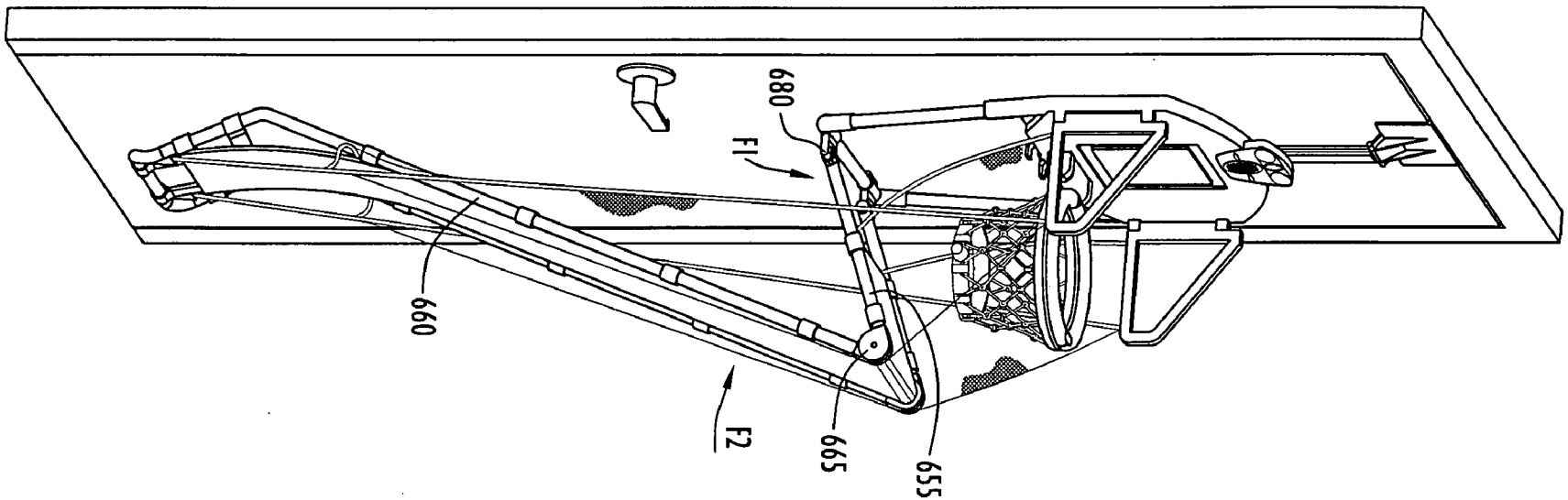
Figure 17:
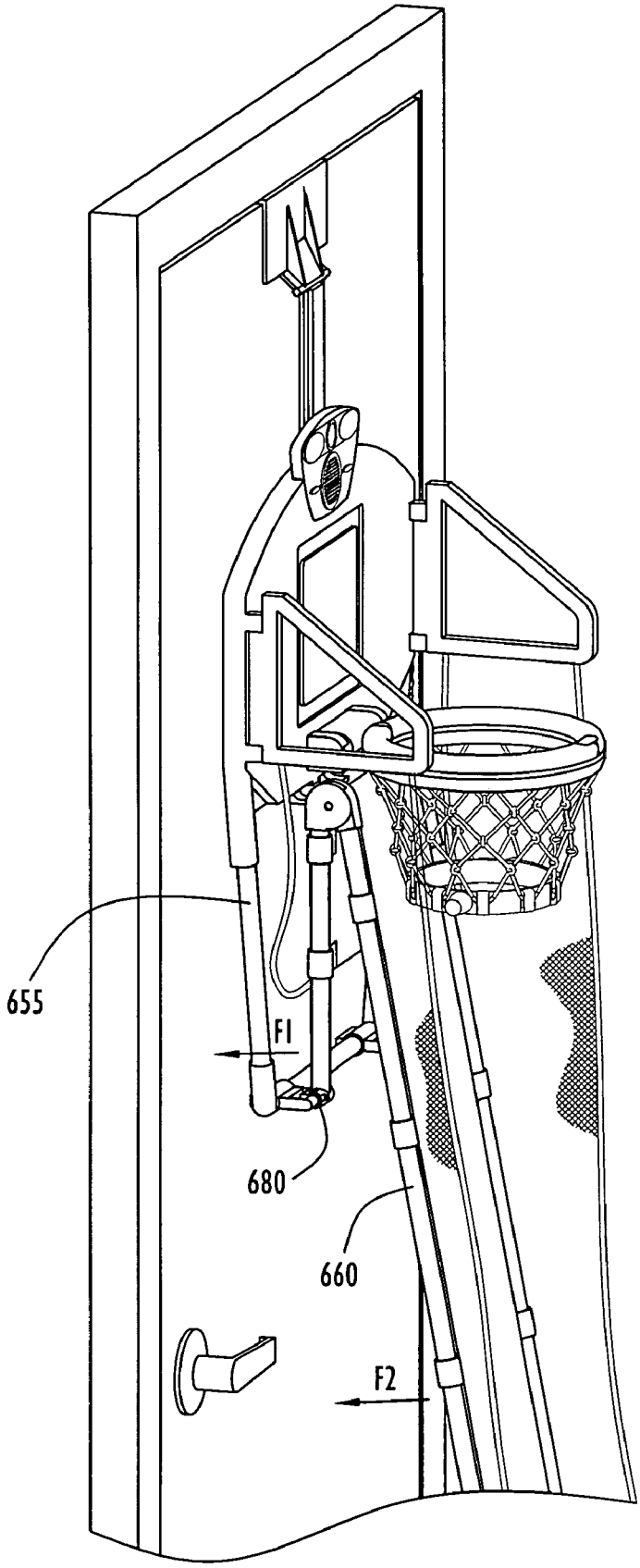
Figure 18A:
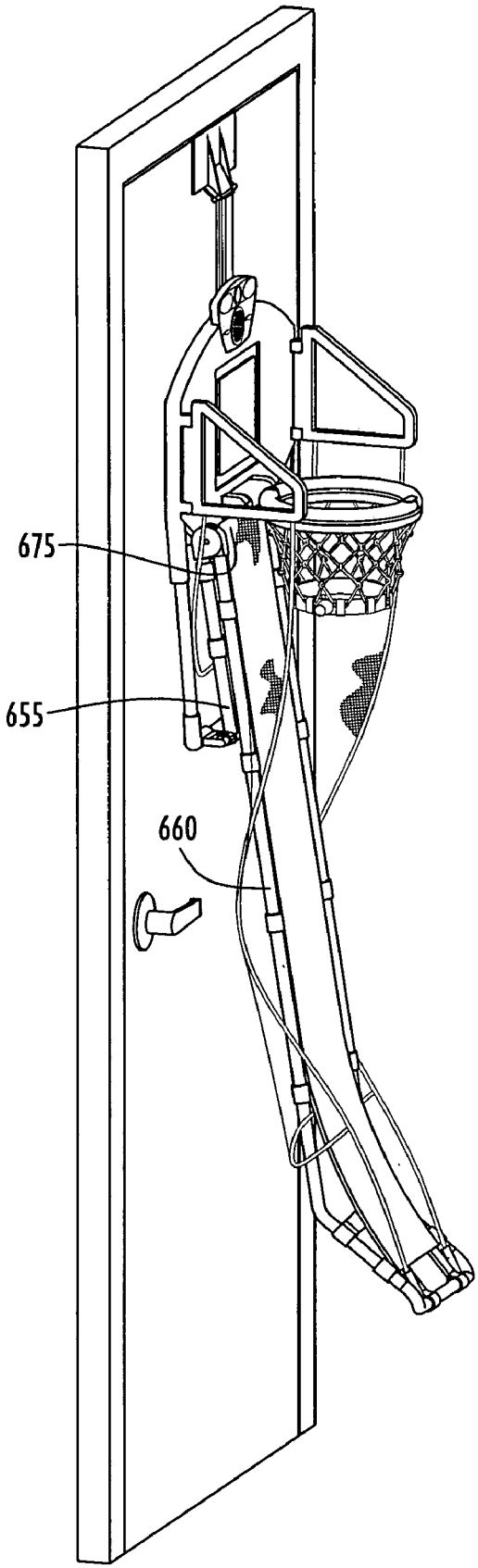
Figure 18B:
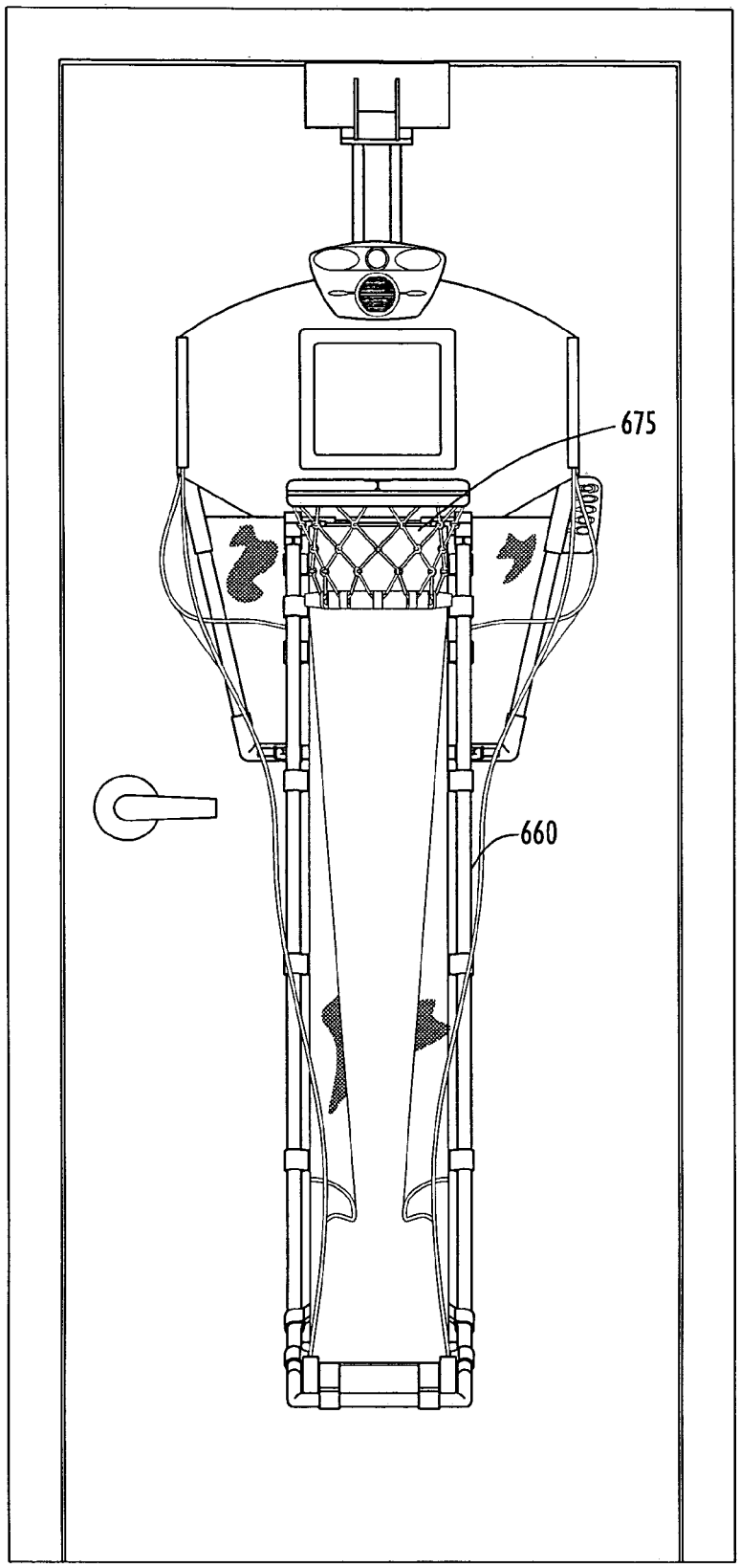

FIGS. 15, 16, 17, 18A, 18B, 19, and 20 illustrate the conversion of the sports-themed game apparatus 10 from its deployed/expanded configuration to its stored/folded configuration. Initially, the sports implement/ball return portion 600 begins in its deployed (extended) position as illustrated in FIG. 10. As shown, the apparatus 10 is mounted on a door D. Referring to FIG. 15, a force is applied to rotate the rear section 655 upward (indicated by arrow F1), while a downward force is applied to front section 660 to rotate the front section 660 toward the door D (indicated by arrow F2). Force F1 engages the ball 680 and socket 685 connection to rotate the rear section 655 toward the support frame 200 (counter clockwise from the viewpoint of FIG. 15). Force F2 engages the pivot joint 665 to rotate the front section 660 with respect to the rear section 655 (i.e., the front section 660 is rotated clockwise from the viewpoint of FIG. 15). Referring to FIGS. 16 and 17, the rotation of the ball and socket connection may continue until the rear section 655 is parallel to the front section 660; additionally, the rotation of the pivot joint 665 may continue until the rear section 655 and the front section 660 are generally parallel to the door D. Referring to FIGS. 18A and 18B, the connection member 675 may then be secured in its storage position using the securing members 125 (not shown in FIGS. 18A or 18B—the securing members 125 are shown in FIG. 2). In operation, the connector member 675 is urged into the securing members 125 and is secured via a frictional fit.

Figure 19:
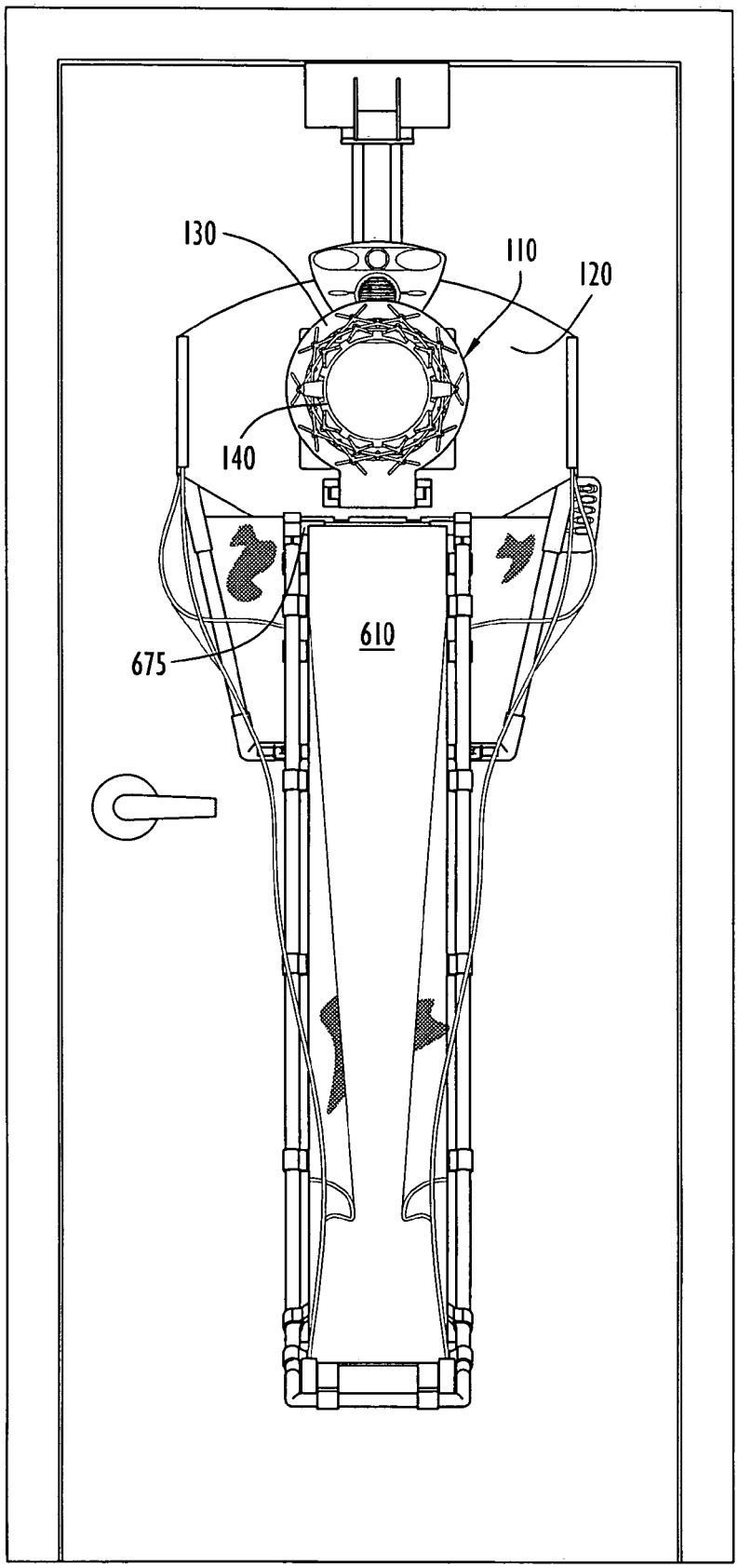
Figure 20:
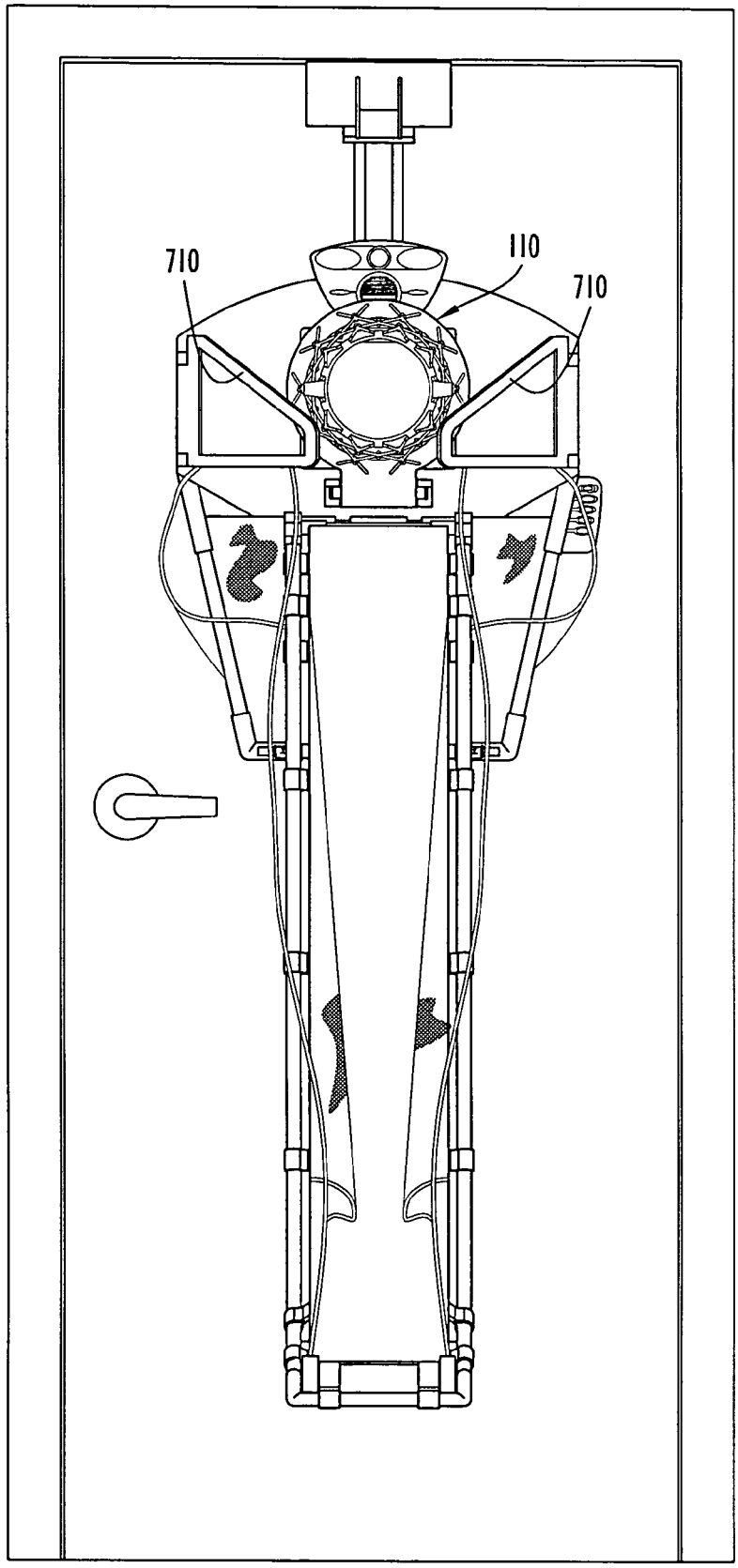

Next, as shown in FIG. 19, the target 110 may then be rotated upward from its horizontal, deployed position to its vertical, storage position (as explained in greater detail above and illustrated in FIGS. 6A–6C). The sidewall brackets 710 may then be rotated from their deployed position (perpendicular to backboard 120) to their storage position (parallel to backboard) (as explained in greater detail above). The apparatus 10 is now in its compact, folded or storage configuration, permitting a user to efficiently store the device when not in use. This storage configuration is illustrated in FIG. 20.

To convert the ball return portion 600 from its folded configuration into its deployed configuration, the above process is reversed, with the connector member 675 being removed from the C-shaped securing members 125, and the rear section 655 being pivoted downward/clockwise via the ball joint 680 and socket 685 connection, and the front section 660 being pivoted upward/counterclockwise about the pivot joint 665. The expanding of the ball return portion 600 ceases when the chute 610 becomes taught. In addition, a stop mechanism may be provided proximate the pivot joint 665 of the support structure 620 (not shown) that prevents the pivot joint 665 from rotating beyond a desired position. Once deployed, the sidewalls 700 may further serve to stabilize the chute 610 and maintain the chute 610 in its deployed configuration.

The sports-themed game apparatus 10 may further include an electronics system configured to generate, track, and display game conditions. In the embodiment illustrated in FIG. 1, the sports-themed game apparatus 10 may include a display device 800 and a switch housing or box 900. The display unit 800 and/or the switch housing 900 may be operably connected to the sensors in the target portion 100. In addition, the display device 800 and/or the switch housing 900 may be operably connected to one or more sensory output generating devices such as speakers, visual displays, etc.

Figure 21:
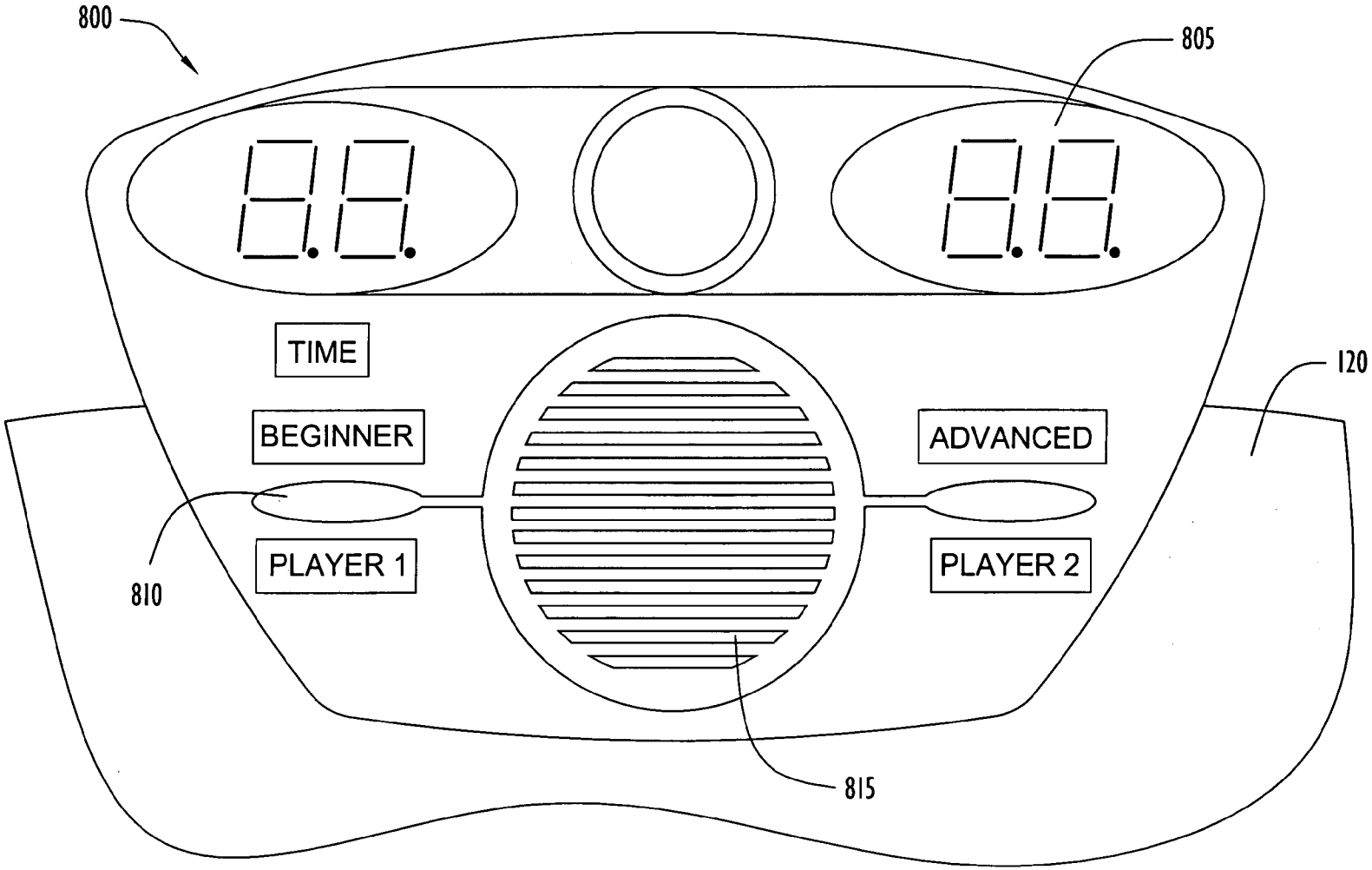
FIG. 21 illustrates a perspective view of a display device according to an embodiment of the invention.

The display device 800 of the sports-themed game apparatus 10 of the present invention comprises a housing adapted to contain electronic sensory output generating devices and to display game information. FIG. 21 illustrates a perspective view of a display device 800 according to an embodiment of the present invention. As shown, the display device 800 includes an upper, numeric display section 805; a lower, indicator light section 810; and a centralized speaker housing section 815. The numeric display section 805 may be operable to display numerical values associated with a particular sport such as basketball. For example, the numeric display section 805 may display values relating to the time remaining in a contest, the game score, etc. The type of display is not limited to that which is disclosed herein. By way of example, the numeric display section 805 may include a six-digit LED display, wherein each digit comprises seven-segments that are selectively illuminated to generate a desired number.

The indicator light section 810 may be configured to selectively illuminate portions of the display device 800. By way of example, the indicator light section 810 may comprise one or more light-emitting elements including, but not limited to, light emitting diodes (LEDs) and grain of wheat bulbs (GOWs). The indicator light section 810 may be used to indicate particular game conditions. Specifically, the LEDs and GOWs may be configured to be associated with indicia located on the housing of the display device 800 to relate to game information such as play level, active player designation, etc. The display device 800 may further include a speaker housing section 815 configured to cover a speaker that is used to generate verbal and nonverbal output (e.g., speech, music, and sound effects).

Figure 22A:
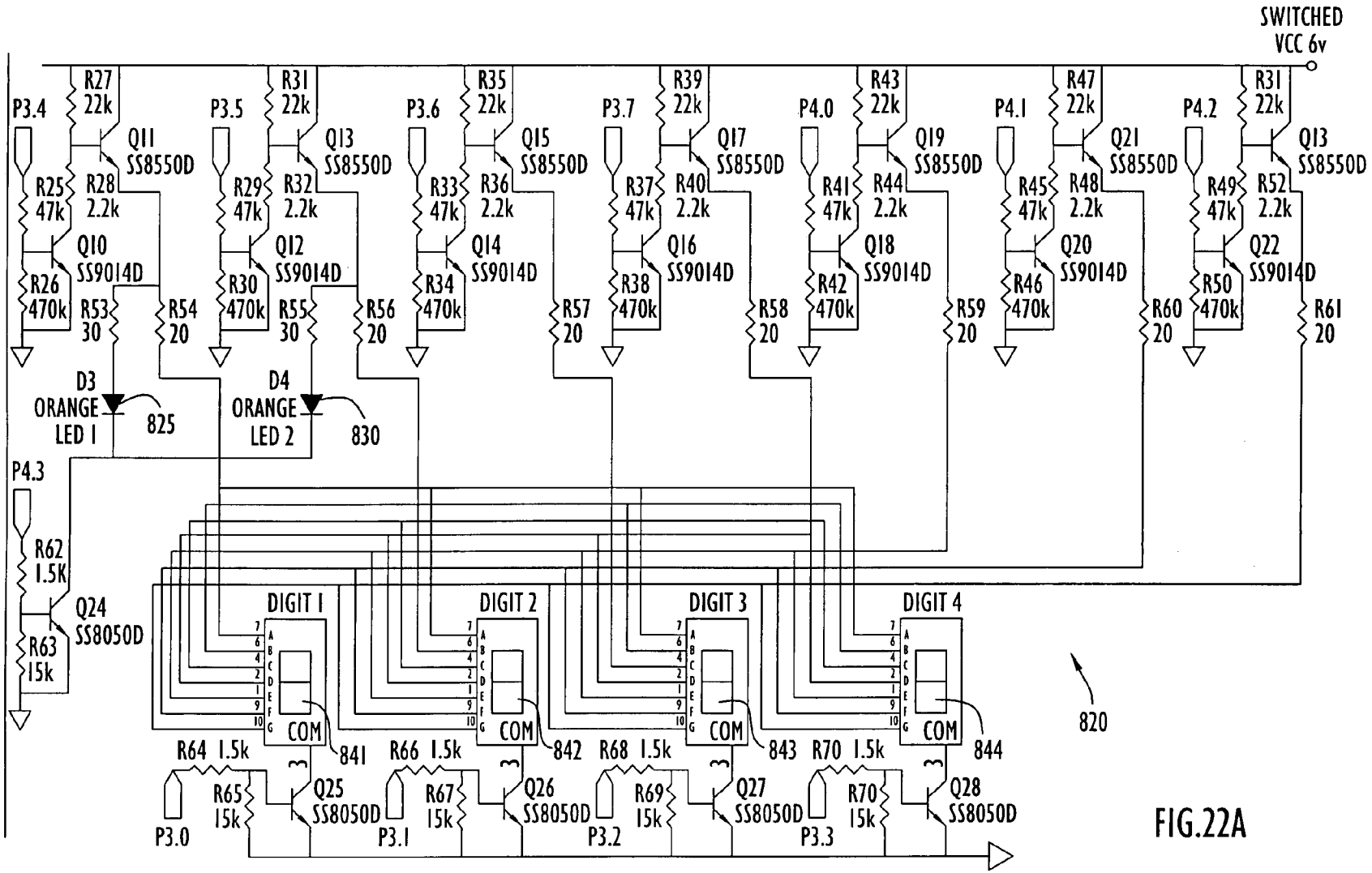
FIGS. 22A and 22B illustrate electrical schematic diagrams of two portions of the electronics configuration for the display device of FIG. 21.
Figure 22B:
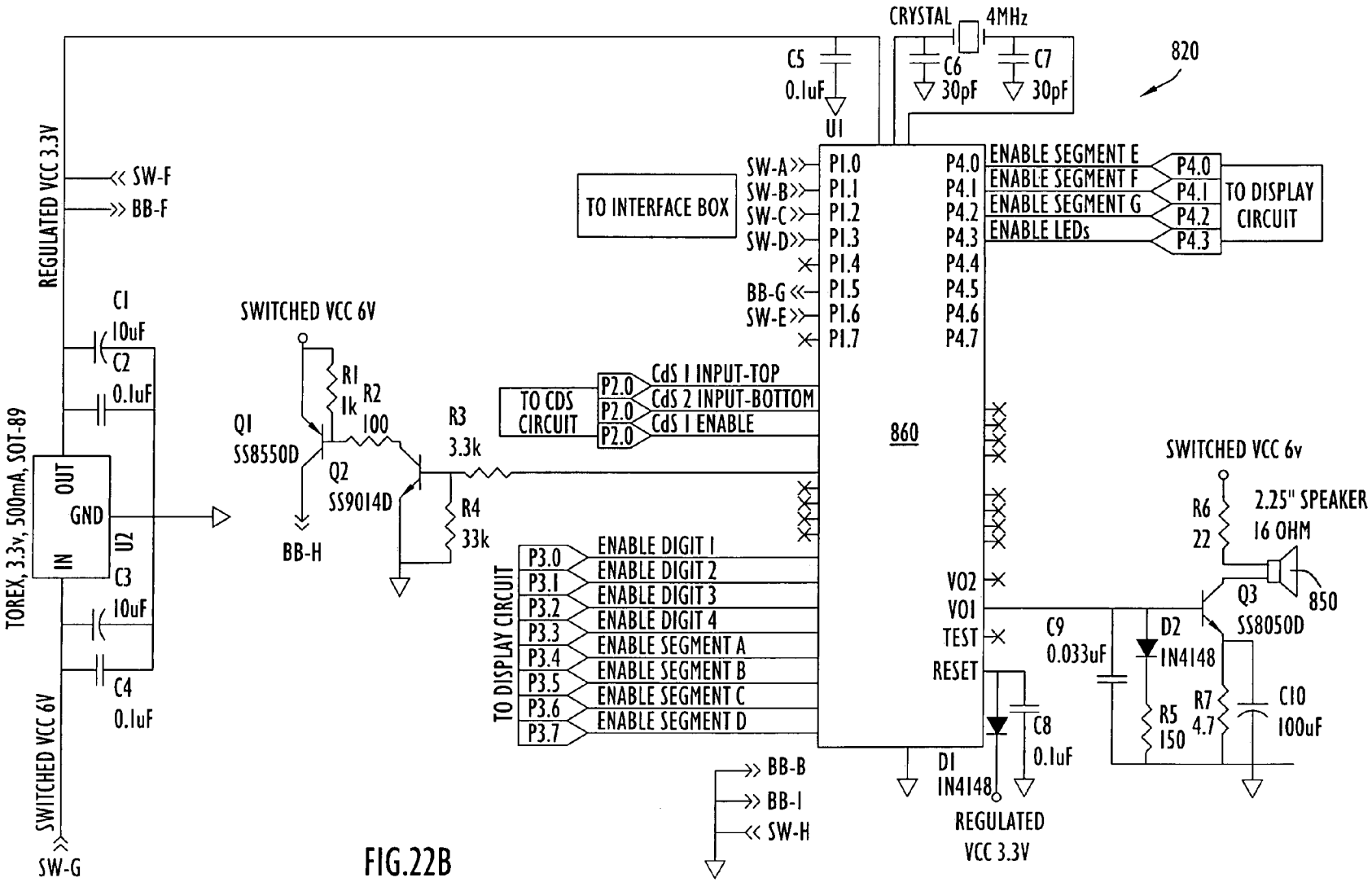

FIGS. 22A and 22B illustrate schematic diagrams of the two portions of the electronics configuration for the display device 800 in accordance with an embodiment of the present invention. Note that the two portions of the electronics configuration for the display device 800 shown in FIGS. 22A and 22B are connected together via standard wiring techniques. The electronics assembly 820 includes one or more sensory output generating devices (e.g., light sources, motors, and speakers) that are engaged and disengaged by one or more switches, as controlled by a control unit. In the embodiment of FIGS. 22A and 22B, the electronics assembly 820 may include: two light emitting diodes (LEDs) 825 (LED1) and 830 (LED2); four digit LEDs 841, (Digit 1), 842 (Digit 2), 843 (Digit 3), 844 (Digit 4); a speaker 850; a power source (not shown in FIG. 22A or 22B, referenced as 935 in FIG. 24) and a control unit 860. The type of LED is not limited to that illustrated herein, and may include colored and white LEDs. By way of specific example, 5 mm superbright LEDs may be used. In addition, grain of wheat bulbs (GOWs) may be used. By way of specific example, 80 mA clear bulbs may be used. The type of digit LED used in the present invention is not limited herein, and may include colored, white and/or clear segments. By way of specific example, common cathode, red ultrabright segments may be used (sold under the trade name WNDC1080RUB-D1, available from Waitrony Co., Ltd., China). Similarly, the type of power source 935 is not limited, and may include direct and alternating current sources. By way of specific example, four "C" batteries may be used.

The control unit 860 may be operably coupled to each of the speaker 850, the power source 935, the LEDs 825, 830, and the digit LEDs 841–844 (e.g., via a ribbon cable). The control unit 860 may comprise, but is not limited to, microcontrollers, microprocessors, and integrated circuits. The control unit 860 may be configured to recognize signals generated by the various sensors/switches and control the operational output of the sports-themed game apparatus 10 (i.e., of the sensory output generating devices). For example, the control unit 860 may activate the light sources 825, 830, 841–844 and the speaker 850 to generate electronic sensory stimulating output such as audio and visual output (e.g., sound effects, verbal messages, music, motion, and light patterns). The control unit 860 further controls the activation of the defense mechanism, pivoting the sections S1, S2 of the secondary hoop 134 to effectuate the shot block and the pass-through modes (as explained above).

The control unit 860 is also capable of controlling the primary and secondary electronic modes of the apparatus 10. The primary electronic modes may designate a game play pattern for playing the sport of basketball, with electronic output based upon that pattern (e.g., create game play situations, scoring rules, game parameters, and sound effects). By way of specific example, the primary electronic mode may include a free play mode, a double defense mode, a beat the clock mode, and a one-on-one mode. For example, the free play mode may generate electronic feedback that rewards a successful score with sound effects and speech (e.g., "Good shot!"), as well as keep a running total of points scored. In the Double Defense play mode, the control unit 860 may create a scenario to see how many points a user can score in a certain amount of time (tracking, e.g., the time elapsed, the points scored, and/or the passes completed) while the defense mechanism is activated (the control unit engages the sections S1, S2 of the secondary hoop 134 to "block" the shot of a user). In the Beat the Clock mode, the control unit 860 may create a scenario to see how many points a user can score in a certain amount of time (tracking, e.g., the time elapsed, the points scored, and/or the passes completed). Finally, in the One-on-One mode, two users are placed in competition, with the computer tracking the respective score of each user.

In addition, the control unit 860 may control a secondary electronic mode. The secondary electronic modes may alter the level of difficulty of the primary game play pattern. For example, the secondary electronic mode may include a "beginner" level and an "advanced" level. Consequently, in each of the above mentioned primary game patterns, the difficulty of each game pattern increases. For example, in the advanced mode, the control unit 860 may increase (compared to the beginner level) the number of times the defense mechanism is engaged (e.g. the number of times the sections S1, S2 of the secondary hoop 134 are pivoted to "block" the shot of a user), alter the amount of time permitted to perform a function, or both.

Figure 23:
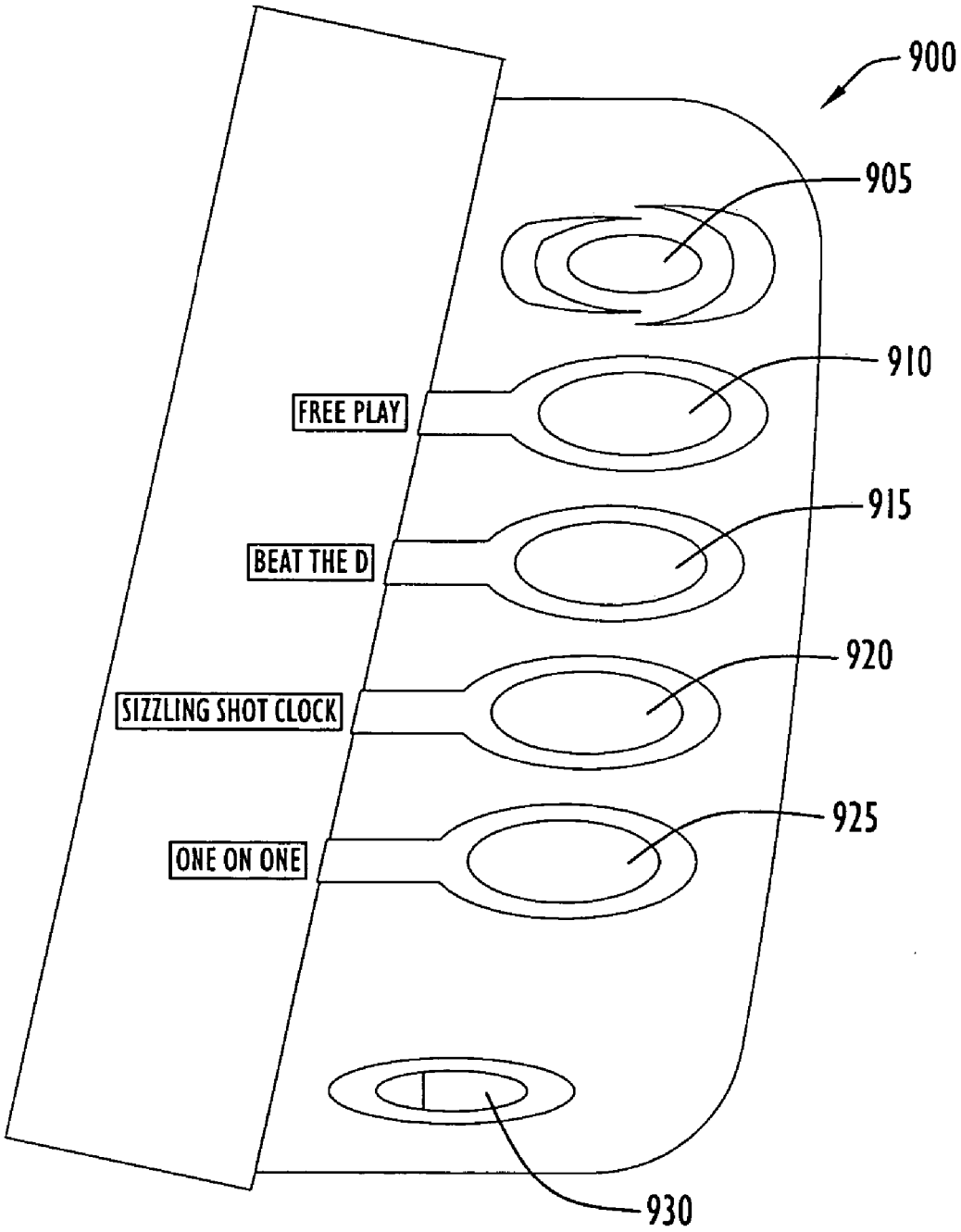
FIG. 23 illustrates a perspective view of a switch housing according to an embodiment of the present invention.

The switch housing 900 may include one or more switches operably connected to the control unit 860. FIG. 23 illustrates a perspective view of a switch housing 900 according to an embodiment of the present invention. As shown in FIG. 23, the switch housing 900 may include six switches 905, 910, 915, 920, 925, and 930. Each switch 905, 910, 915, 920, 925, and 930 may comprise, but is not limited to, a mechanical switch (pressure sensitive, contact, push, pivot, and slide), an electrical switch, a magnetic switch, an optical switch, etc. The number of switches, moreover, is not limited to that illustrated herein. Furthermore, the switch housing 900 may further include other electronic components (lights, speakers, etc.).

Figure 24:
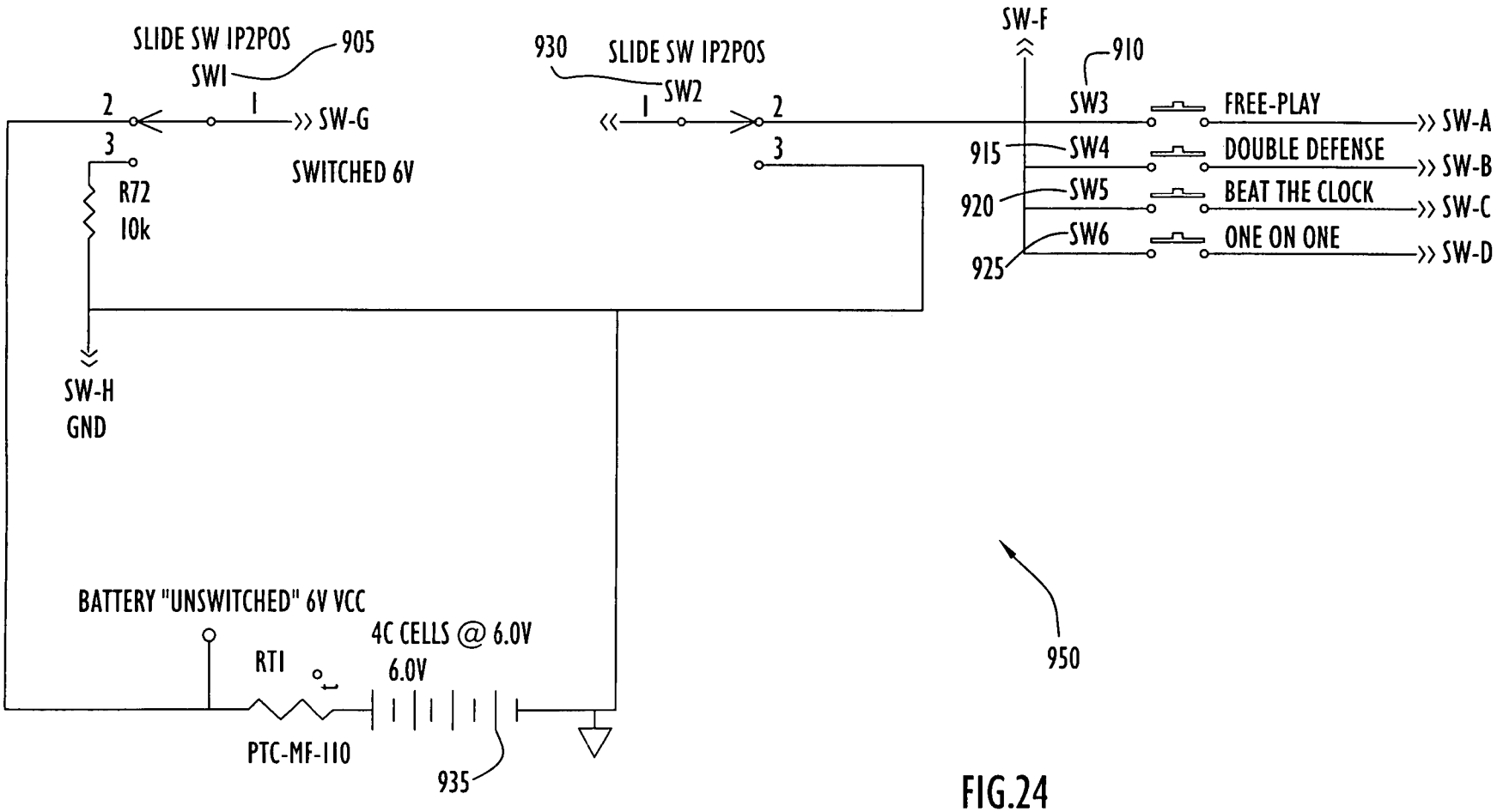
FIG. 24. illustrates an electrical schematic diagram of an electronic assembly associated with the switch housing of FIG. 23.

FIG. 24 illustrates a schematic diagram of an electronic assembly 950 associated with the switch housing 900. In the embodiment shown, the electronics assembly 950 may include six switches 905 (SW1), 910 (SW3), 915 (SW4), 920 (SW5), and 925 (SW6), and 930 (SW2). Switches 905, 910, 915, 920, 925, and 930 may each correspond to the switches of the switch housing 900 as illustrated in FIG. 23. Specifically, switch 905 may be used to indicate that switch SW1 has been engaged (to provide or discontinue power to the electronics assembly 950). Switches 910, 915, 920, and 925 may be used to indicate the corresponding switches on the switch box 910 (free play), 915 (beat the D/double D), 920 (shot clock), and 925 (one on one), have been engaged (to select a game mode and alter the output of the sports-themed game apparatus 10 in accordance with the game selected). Finally, switch 930 may be used to indicate the corresponding switch 930 on the switch box has been engaged (to alter the level of difficulty of the game play).

Figure 25:
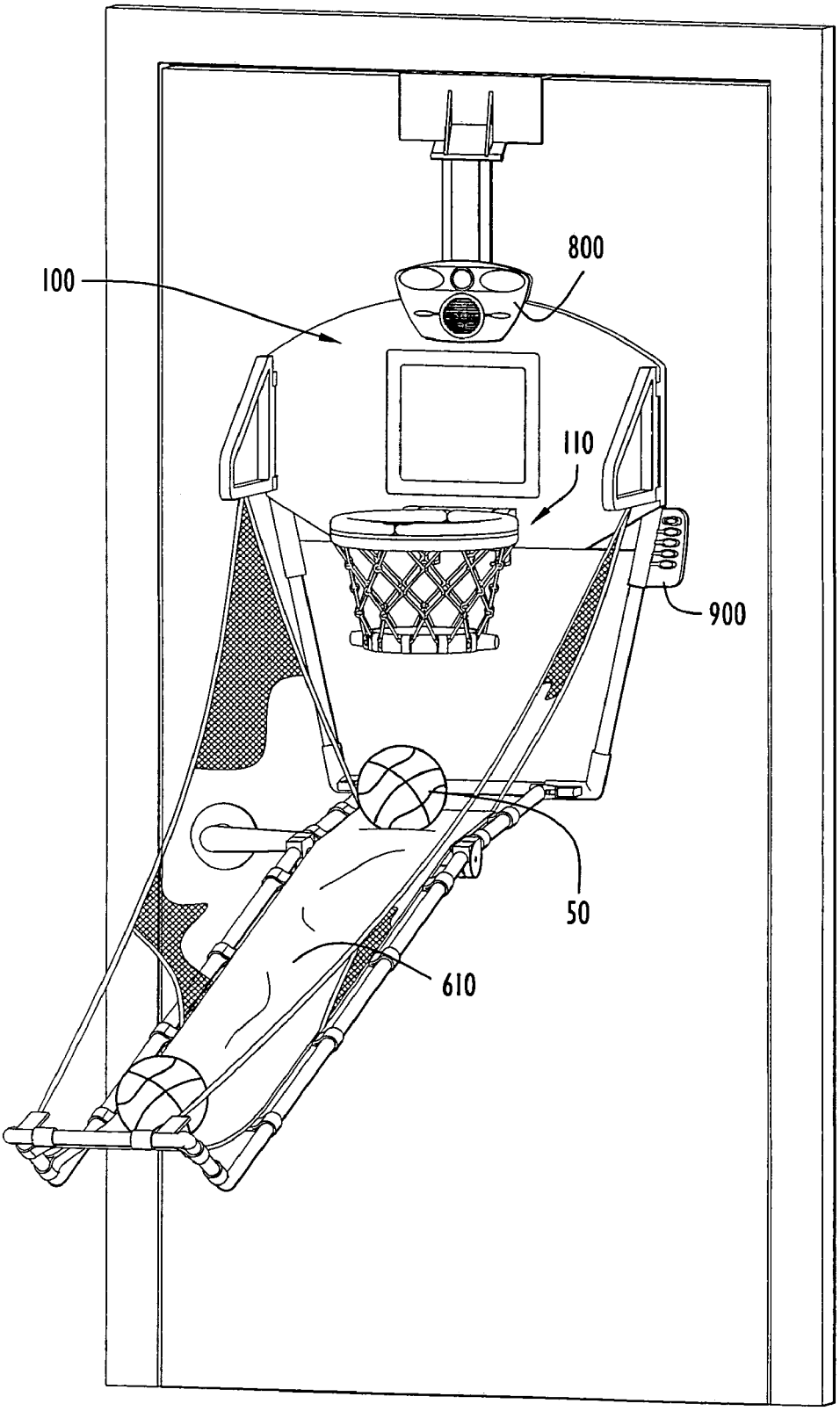
FIG. 25 illustrates a front view of the sports-themed game apparatus FIG. 1, showing the use of the game apparatus and the ball return mechanism.

The above-disclosed sports-themed game apparatus 10 provides a game that can be reoriented from a deployed configuration to a storage configuration and vice versa. FIG. 25 illustrates a front view of the sports-themed game apparatus of FIG. 1, showing the use of the apparatus 10 and chute 610 of the ball return portion 600. As explained above, the apparatus 10 is placed in its deployed configuration by unfolding the return portion 600. The user may then activate the electronics assembly to choose an electronic game mode (by engaging the switches of the switch housing 900) and begin game play. The user begins game play, shooting a sports implement 50 (a basketball) at the target 110 of the target portion 100. Should the ball 50 pass through the target 110 (rings 130 and 140), the sensor within the target 110 will detect the passage of the ball 50 through the rings 130, 140. The ball 50 will then fall onto the chute 610 of the return portion 600, and begin rolling down toward the handlebar 630 and back to the user. In addition, a successful goal is recorded and displayed on the display device 800.

If the defense mechanism is activated, the shot taken by the user may be deflected by the pivoting of sections S1, S2 of the secondary hoop 134, thus preventing the ball 50 from passing through the target 110. Should the ball 50 not travel through the target 110 (because it missed or was blocked by the sections S1, S2), and should the ball 50 travel outside the pathway of the chute 610 (lose contact with the chute 610), the sidewalls 700 will redirect the ball toward the chute 610. In addition, whether the shot is made, missed, or blocked, the ball 50 will travel down the chute 610 and back toward the user.

While the invention has been described in detail and with reference to specific embodiments thereof, it will be apparent to one skilled in the art that various changes and modifications can be made therein without departing from the spirit and scope thereof. For example, the sports-themed game apparatus 10 can be of any size and shape. The sports-themed game apparatus 10 need not be sized for use by only children, and can be sized larger for adult use. The material comprising the frame 100 is not limited, and may include tubes comprising metal (e.g., aluminum or steel). The number and type of separate target portions 100 is not limited to that disclosed herein. The target portion 100 may include any number of rims or targets 110.

While explained with reference to the game of basketball, the device may be adapted for use with other sports. For example, instead of a basketball basket, the sports-themed game apparatus 10 of the present invention may include a target 110 for other thrown, shot, or tossed sports implements such as a baseball or football. Specific examples of the provision of a target for these types of variations are disclosed in aforementioned U.S. patent application Ser. No. 11/032,221, entitled Convertible Game Apparatus, incorporated herein by reference in its entirety.

The electronics assemblies in accordance with the present invention may include any combination of sensors, switches, lights, speakers, animated members, motors, and sensory output generating devices. The control unit 860 may produce any combination of audio and visual effects including, but not limited to, animation, lights, and sound (music, speech, and sound effects). The output pattern is not limited to that which is discussed herein and includes any pattern of music, lights, and/or sound effects. The electronics system may also include additional switches or sensors to provide additional sensory output activation without departing from the scope of the present invention.

Thus, it is intended that the present invention cover the modifications and variations of this invention that come within the scope of the appended claims and their equivalents. For example, it is to be understood that terms such as "left", "right" "top", "bottom", "front", "rear", "side", "height", "length", "width", "upper", "lower", "interior", "exterior", "inner", "outer" and the like as may be used herein, merely describe points of reference and do not limit the present invention to any particular orientation or configuration.

I claim:

1. An apparatus comprising:

a basketball rim configured to receive a basketball;

a frame to support the basketball rim over a surface;

a defense mechanism forming part of the rim; and a motorized drive mechanism coupled to the defense mechanism, the drive mechanism moving the defense mechanism from a first position in which the defense mechanism permits the basketball to pass through the rim, to a second position in which the defense mechanism prevents the basketball from passing through the rim.

2. The apparatus of claim 1, wherein the frame is adapted to mount on a door.

3. The apparatus of claim 1, wherein the rim is configured to be disposed in a folded, storage position and an extended, deployed position.

4. The apparatus of claim 3 further comprising a backboard, wherein the basketball rim is rotatably coupled to a backboard and the rim is substantially perpendicular to the backboard when disposed in the deployed position, and is substantially parallel to the backboard when deployed in the storage position.

5. The apparatus of claim 1 further comprising a ball return portion coupled to the frame and configured to return the basketball to a user after it is shot toward the basketball rim.

6. The apparatus of claim 5, wherein the ball return portion is configured to be disposed in a folded, storage position and an extended, deployed position.

7. The apparatus of claim 6, wherein the ball return portion is disposed in the deployed position and is configured to separate from the frame when a predetermined force is applied to the ball return portion.

8. The apparatus of claim 6 further comprising a containment member associated with the ball return portion.

9. The apparatus of claim 8, wherein the ball return portion is disposed in the deployed position and the containment member maintains the basketball in proximity to the rim.

10. The apparatus of claim 1 further comprising a sensor element associated with the basketball rim, wherein the sensor element is operable to detect the passage of a basketball through the basketball rim.

11. The apparatus of claim 10, wherein the sensor element associated with the basketball rim is an optical sensor.

12. The apparatus of claim 1, wherein the basketball rim comprises a primary hoop and the defense mechanism comprises a secondary hoop disposed over the primary hoop.

13. The apparatus of claim 12, wherein the secondary hoop comprises first and second sections pivotally connected to the primary hoop, wherein the sections are positioned substantially parallel to the primary hoop when deployed in the first defense mechanism position and wherein the sections are positioned substantially perpendicular to the primary hoop when deployed in the second defense mechanism position.

14. An apparatus comprising:

a rim configured to receive a propelled sports implement;

a frame to support the rim over a surface;

a defense mechanism forming part of the rim; and a motorized drive mechanism coupled to the defense mechanism, the drive mechanism moving the defense mechanism from a first position in which the defense mechanism permits the sports implement to pass through the rim, to a second position in which the defense mechanism prevents the sports implement from passing through the rim.

15. The apparatus of claim 14, wherein the frame is adapted to mount on a door.

16. The apparatus of claim 14, wherein the rim is configured to be disposed in a folded, storage position and an extended, deployed position.

17. The apparatus of claim 14 further comprising a sports implement return portion coupled to the frame and configured to return the sports implement to a user after it is propelled toward the rim by a user.

18. The apparatus of claim 17, wherein the sports implement return portion is configured to be disposed in a folded, storage position and an extended, deployed position.

19. The apparatus of claim 14, wherein the rim comprises a primary rim and the defense mechanism comprises a secondary rim disposed over the primary rim.

20. The apparatus of claim 19, wherein the secondary rim comprises first and second sections pivotally connected to the primary rim, wherein the sections are positioned substantially parallel to the primary rim when deployed in the first defense mechanism position, and wherein the sections are positioned substantially perpendicular to the primary rim when deployed in the second defense mechanism position.

* * * * *